US006686813B2

(12) United States Patent
Hiroshima et al.

(10) Patent No.: US 6,686,813 B2
(45) Date of Patent: Feb. 3, 2004

(54) DIELECTRIC FILTER, DIELECTRIC DUPLEXER, AND COMMUNICATION APPARATUS

(75) Inventors: Motoharu Hiroshima, Ishikawa-ken (JP); Jun Toda, Ishikawa-ken (JP); Hideyuki Kato, Ishikawa-ken (JP)

(73) Assignee: Murata Manufacturing Co. Ltd. (JP)

( * ) Notice: Subject to any disclaimer, the term of this patent is extended or adjusted under 35 U.S.C. 154(b) by 66 days.

(21) Appl. No.: 10/013,766

(22) Filed: Dec. 11, 2001

(65) Prior Publication Data

US 2002/0075095 A1 Jun. 20, 2002

(30) Foreign Application Priority Data

Dec. 19, 2000 (JP) ..... 2000-385974
May 10, 2001 (JP) ..... 2001-140397

(51) Int. Cl.[7] ..... H01P 5/12
(52) U.S. Cl. ..... 333/134; 333/202; 333/206
(58) Field of Search ..... 333/134, 206, 333/202, 207, 222, 223, 126, 129

(56) References Cited

U.S. PATENT DOCUMENTS 5,905,420 A * 5/1999 Tsujiguchi et al. ..... 333/206
6,278,343 B1 * 8/2001 Okada et al. ..... 333/206
6,483,405 B1 * 11/2002 Toda et al. ..... 333/206

FOREIGN PATENT DOCUMENTS

EP 0 809 315 11/1997
JP 08-018306 1/1996

OTHER PUBLICATIONS

UK Patent Office Search Reported dated Aug. 20, 2002.

* cited by examiner

*Primary Examiner*—Robert Pascal
*Assistant Examiner*—Kimberly E Glenn
(74) *Attorney, Agent, or Firm*—Dickstein, Shapiro, Morin & Oshinsky, LLP.

(57) ABSTRACT

A dielectric filter and a dielectric duplexer, which obviate the need to change the design of a circuit board when the dielectric filter or the dielectric duplexer are to be changed and in which the degree of freedom of design is improved, and a communication apparatus using them are constructed. Resonator holes having internal conductor formed on the respective inner surfaces thereof, and excitation holes are provided in a dielectric block, and electrodes and an external conductor are formed on the outer surface of the dielectric block. The positions of input/output coupling electrodes on the mounting surface with respect to the circuit board are aligned with the positions of the input/output coupling electrodes on the circuit board. At least one of the electrodes provided on the opening surfaces of the resonator holes is disposed in a direction which is not perpendicular to the mounting surface.

44 Claims, 14 Drawing Sheets

DIELECTRIC FILTER, DIELECTRIC DUPLEXER, AND COMMUNICATION APPARATUS

BACKGROUND OF THE INVENTION

1. Field of the Invention

The present invention relates to dielectric filters (including dielectric duplexers) and a communication apparatus using such dielectric filters.

2. Description of the Related Art

Dielectric filters are typically formed using a rectangular parallelepiped dielectric block having a plurality of through holes formed therein. The through holes are plated with internal conductors and an external conductor is formed on the outer surface of the dielectric block, thereby forming a plurality of resonators by the internal conductors, the external conductor, and the portion of the dielectric block located between the conductors. Such filters have been used in communication devices which operate in the microwave band.

There are various possible constructions for the external coupling for such resonators, which can be selected according to the characteristics to be obtained. One such arrangement is shown in Japanese patent 2885119 (Japanese Unexamined Patent Application Publication No. 8-18306) wherein an excitation hole is coupled to a desired resonator. The excitation hole extends parallel to the resonator hole. The internal conductor, which is located on the inner surface of the resonator hole, is connected to the external conductor at one of the openings and is connected to an input/output electrode at the other opening. Furthermore, the input/output electrode extends to the mounting surface of the dielectric block, so that surface mounting is possible.

The degree of external coupling via the excitation hole is determined mainly by the spacing between the excitation hole and the resonator hole. Also, the degree of coupling between the adjacent resonators is determined mainly by the spacing between the adjacent resonators. Therefore, the size of the dielectric block is determined by the number of resonator holes which are in turn determined according to the required characteristics of the filter, the strength of coupling between resonators, the strength of external coupling, etc. At the same time, the position of the contact terminals on the circuit board on which the dielectric filter is mounted is designed to be in alignment with the position of the input/output electrodes of the dielectric filter.

When the dielectric filter and/or the dielectric duplexer is to be redesigned to have different characteristics, the position and spacing of its resonator holes and/or excitation holes will normally change. As a result, the position of the input/output electrodes of the filter will normally change. In such a case, it is preferable to redesign the circuit board to ensure that the contact terminals on the circuit board align with the new position of the input/output electrodes on the redesigned dielectric filter.

Unfortunately, this is not always possible. Sometimes the circuit board cannot be changed. In such a case, it is necessary to redesign the filter without moving the location input/output electrodes thereof. In such a case, the pattern of the input/output electrodes on the mounting surface of the filter must conform to the pattern of the contact terminals on the circuit board and not vice versa and there is a high possibility that improvements cannot be made to optimize the characteristics of the filter due to the limitation of the dimensions thereof.

Even where the circuit board can be redesigned, design constraints (e.g., the location of other elements on the circuit board) may limit the positions on which the contact electrodes can be placed such that it is not possible to align the contact electrodes with the position of the excitation holes. In such a case, some provision must be made for offsetting the position of the input/output electrodes relative to the excitation holes.

SUMMARY OF THE INVENTION

An object of the present invention is to provide a dielectric filter which obviates the need to change the design of the circuit board when the design of the dielectric filter is to be changed and in which the degree of freedom of design of the dielectric filter is improved. A further object of the present invention is to provide a communication apparatus using such a dielectric filter. To this end, at least one of the excitation holes has an input/output electrode associated therewith, the input/output electrode has a contact portion located on the mounting surface of the dielectric block at a position which is offset from the location of the excitation hole as viewed along the plane of the mounting surface. The input/output electrode also has a connection portion extending from the contact portion to the excitation hole.

According to one aspect of the present invention, the dielectric filter comprises:

- a dielectric block having a plurality of outer surfaces including a front surface and a planar mounting surface extending perpendicular to said front surface, said dielectric block including an excitation hole and a resonator hole, both of which extend from said front surface in a direction parallel to said mounting surface;
- an excitation hole conductor formed on an inner surface of said excitation hole;
- a resonator hole conductor formed on an inner surface of said resonator hole;
- an input/output electrode electrically coupled to said excitation hole internal conductor, said input/output electrode including a connection portion located on said front surface and a contact portion located on said mounting surface, said contact portion being offset from said excitation hole as viewed along the plane of said mounting surface; and
- an external conductor, which is insulated from said input/output electrode, formed on a plurality of said outer surfaces.

With this construction, the dielectric filter is formed in such a way that the position of the contact portion of the input/output electrode is brought into alignment with the position of the mounting terminal on the circuit board, so that the position of the excitation hole in the dielectric block can be determined according to the required design characteristics of the filter despite non-alignment of the excitation hole and the mounting terminal. This is advantageous both when a new dielectric filter is designed for use on an existing circuit board and when the dielectric filter is designed for a new circuit board but the design constraints of the circuit board limit the permissible positions of the contact terminals on the circuit board.

In several preferred embodiments, a recessed portion is formed on one of the sides of the dielectric block, one end of the excitation hole is opened in the recessed portion, and an electrode for conducting between the internal conductor on the inner surface of the excitation hole and the input/output electrode formed on the mounting surface is formed in the recessed portion. As a result, the case in which an input/output terminal is not disposed in the outer peripheral portion of the dielectric filter can also be dealt with.

In accordance with another aspect of the present invention, the dielectric filter comprises:

a dielectric block having a plurality of outer surfaces including a front surface, a recessed surface which lies parallel to and spaced from said front surface and a planar mounting surface extending perpendicular to said front and recessed surfaces, said dielectric block including an excitation hole which extends from said recessed surface in a direction parallel to said mounting surface and a resonator hole which extends from said front surface in a direction parallel to said mounting surface;

an excitation hole conductor formed on an inner surface of said excitation hole;

a resonator hole conductor formed on an inner surface of said resonator hole;

an input/output electrode electrically coupled to said excitation hole internal conductor, said input/output electrode including a connection portion located on said recessed surface and a contact portion located on said mounting surface, said contact portion being offset from said excitation hole as viewed along the plane of said mounting surface; and an external conductor, which is insulated from said input/output electrode, formed on a plurality of said external surfaces of said dielectric block.

In accordance with a further aspect of the present invention, the dielectric filter comprises:

a dielectric block having a plurality of outer surfaces including a front surface and a planar mounting surface extending perpendicular to said front surface and a recess formed in said block at the intersection of said front and mounting surfaces, said recess including a recessed surface spaced from and lying parallel to said mounting surface, said dielectric block including a resonator hole and an excitation hole, both of which extend from said front surface in a direction parallel to said mounting surface;

an excitation hole conductor formed on an inner surface of said excitation hole;

a resonator hole conductor formed on an inner surface of said resonator hole;

an input/output electrode electrically coupled to said excitation hole internal conductor, said input/output electrode including a first connection portion located on said front surface and a second connection portion located on said recessed surface and a contact portion located on said mounting surface, said contact portion being offset from said excitation hole as viewed along the plane of said mounting surface; and an external conductor, which is insulated from said input/output electrode, formed on a plurality of said external surfaces of said dielectric block.

In accordance with a further aspect of the invention, the dielectric filter comprises:

a dielectric block having a plurality of outer surfaces including a front surface and a planar mounting surface extending perpendicular to said front surface and a recess formed in said block at the intersection of said front and mounting surfaces, said recess including a recessed surface spaced from and lying parallel to said mounting surface, said dielectric block including a resonator hole extending from said front surface in a direction parallel to said mounting surface;

a resonator hole conductor formed on an inner surface of said resonator hole;

a coupling electrode formed on said front face and electrostatically coupled to said resonator hole conductor;

an input/output electrode electrically coupled to said coupling electrode, said input/output electrode including a connection portion located on said recessed surface and a contact portion located on said mounting surface, said contact portion being offset from said excitation hole as viewed along the plane of said mounting surface; and an external conductor, which is insulated from said input/output electrode, formed on a plurality of said external surfaces of said dielectric block.

The present invention is further directed to a dielectric duplexer including the foregoing filters.

Further objects, features and advantages of the present invention will become apparent from the following description of the preferred embodiments with reference to the attached drawings.

BRIEF DESCRIPTION OF THE DRAWINGS

Other features and advantages of the present invention will become apparent from the following description of the invention which refers to the accompanying drawings.

DESCRIPTION OF THE PREFERRED EMBODIMENTS

First Embodiment

The construction of a dielectric filter according to a first embodiment of the present invention will now be described below with reference to FIGS. 1A and 1B.

Figure 1A:
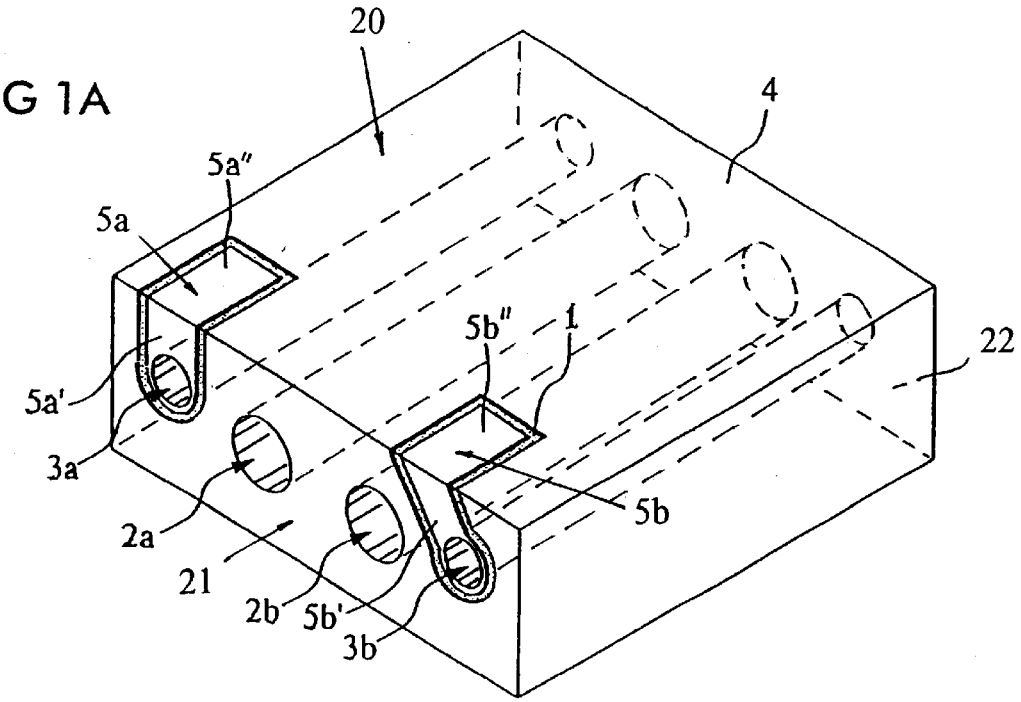
FIGS. 1A and 1B are perspective views of a dielectric filter according to a first embodiment of the present invention.

FIG. 1A is a perspective view of a dielectric filter in which its mounting surface 20 (the surface of the filter which will be mounted on a circuit board) faces upward. FIG. 1B is a perspective view in which the dielectric filter of FIG. 1A has been rotated 180° within the plane of the sheet on which FIG. 1A is drawn.

The dielectric filter preferably comprises a rectangular parallelepiped block 1 of dielectric material having an external conductor 4 formed on its six outer surfaces. A pair of resonator through holes 2*a*, 2*b* are formed in the dielectric block and extend from the front surface 21 of the dielectric block to the rear surface 22 thereof. A respective internal conductor is formed on the inner surface of each of the resonator holes. As shown in FIG. 1A, one end of the inner conductor of each of the resonator holes 2*a* and 2*b* is directly coupled to the external conductor 4 to form a short circuit end of the resonators. As shown in FIG. 1B, the other end of the inner conductors is open circuited from the external conductor 4 by an unplated gap g located in the through hole.

Excitation holes 3*a* and 3*b* also extend through the dielectric block and are disposed parallel to the resonator holes 2*a* and 2*b*. Respective internal conductors are formed on the inner surface of each of the excitation holes. As shown in FIG. 1B, these internal conductors are short-circuited with the external conductor 4 on the rear surface 22 of the dielectric block 1. As shown in FIG. 1A, the outer end of the internal conductors formed on the inner surface of the excitation holes are directly coupled to input/output electrodes 5*a*, 5*b*, respectively. The input/output electrodes 5*a*, 5*b* include respective connection portions 5*a*', 5*b*' located on the front surface 21 of the dielectric block 1 and respective contact portions 5*a*", 5*b*" located on the mounting surface 20 of the dielectric block 1. The external electrodes 5*a*, 5*b* are spaced from, and thereby insulated from, the external conductor 4.

The positions and spacing of the contact portions 5*a*" and 5*b*" on the mounting surface 20 are determined in accordance with the corresponding positions and spacing of the contact terminals on the circuit board to which they are to be connected. On the other hand, the position of the excitation holes 3*a*, 3*b* are determined as a function of the characteristics of the filter including the desired degree of coupling between the excitation holes 3*a*, 3*b* and their respective resonator holes 2*a* and 2*b*. In this embodiment, the position of the contact portion 5*b*" does not align with its associated excitation hole 3*b* as viewed in the plane of the mounting surface 20.

To compensate for this offset, the connection portion 5*b*' extends at an oblique angle relative to (more generally not perpendicular to) the mounting surface 20. As a result, the positions and spacing of the contact portions 5*a*", 5*b*" can be different than the position and spacings of the excitation holes 3*a*, 3*b*. This flexibility allows the positions of the contact portions 5*a*", 5*b*" to be easily matched to the contact terminals on the circuit board, thereby making it possible to redesign the characteristics of the filter without redesigning the structure of the circuit board. It also makes it possible to match the designs of a new filter and a new circuit board where the design constraints of the circuit board limit the permissible locations of the contact terminals thereon.

Figure 1B:
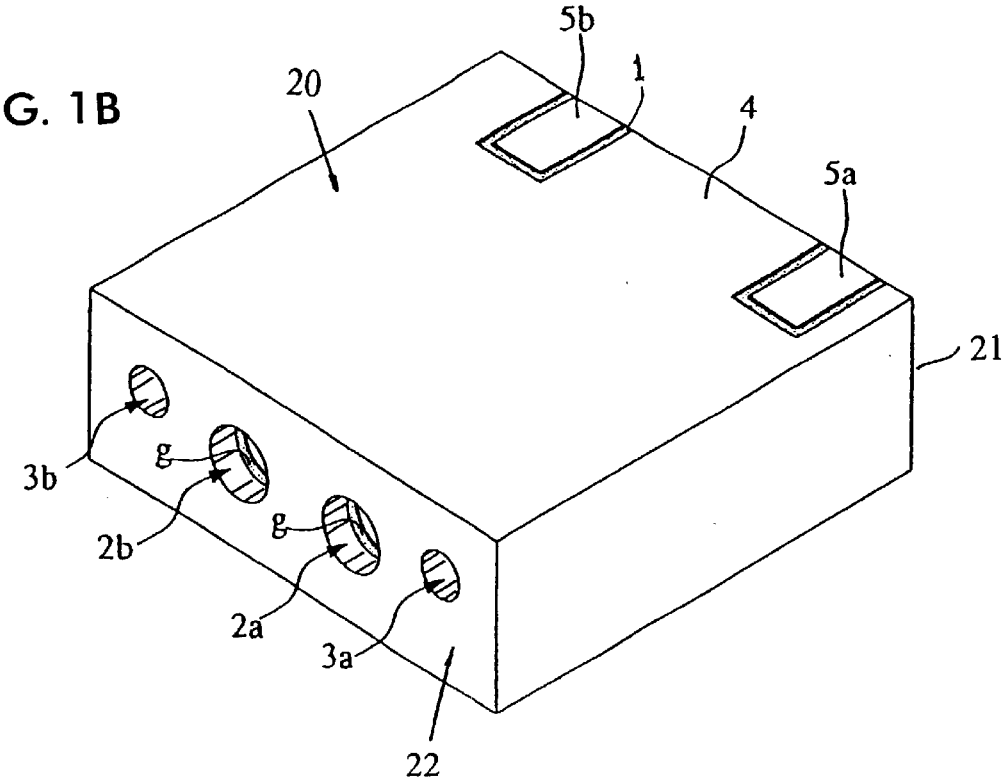

With the construction shown in FIGS. 1A and 1B, each of the two resonators function as a quarter-wave resonator and are inductively coupled with each other. Also, the internal conductor on the inner surface of the excitation holes 3*a*, 3*b* are coupled with each other in an interdigital manner. As a result, the dielectric filter functions as a two stage band-path filter.

Second Embodiment

Figure 2A:
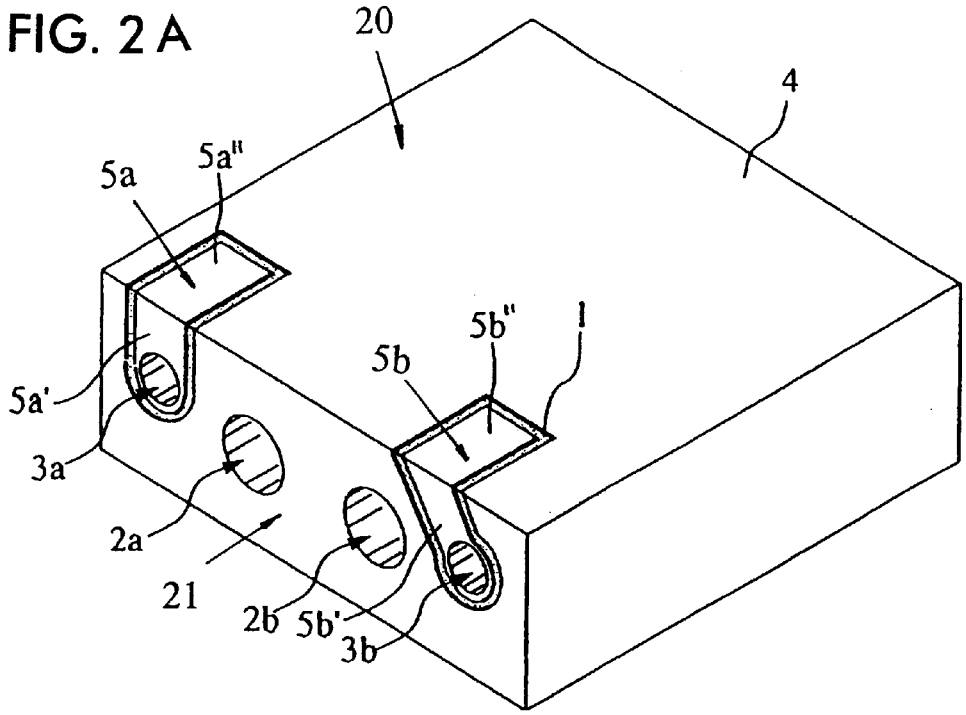
FIGS. 2A and 2B are perspective views of a dielectric filter according to a second embodiment of the present invention.
Figure 2B:
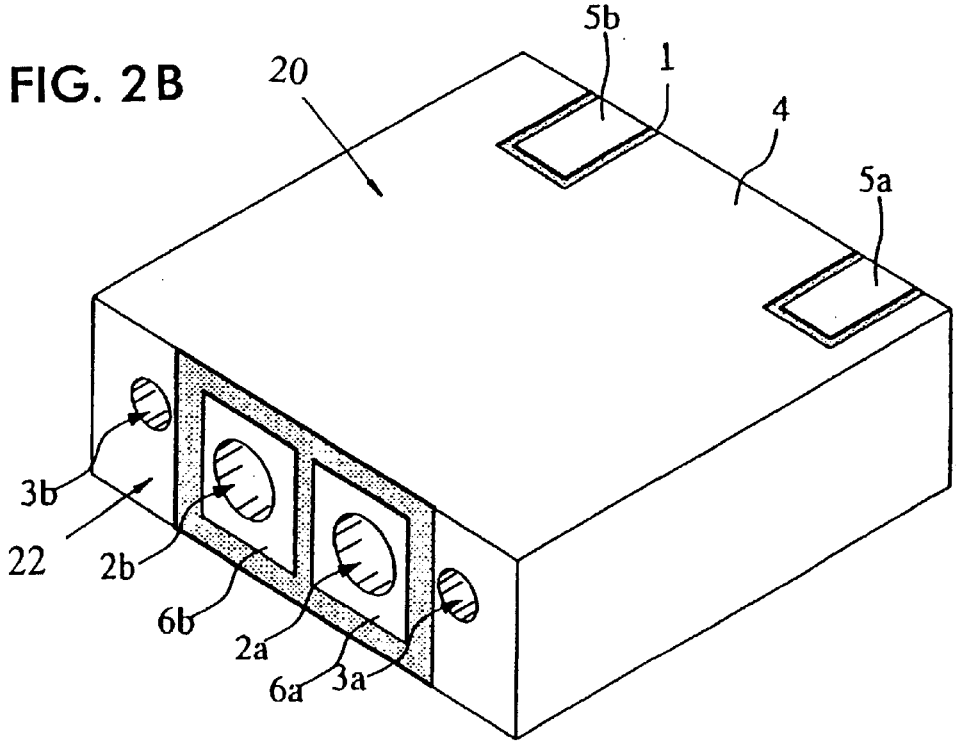

Next, the construction of a dielectric filter according to a second embodiment of the present invention will be described below with reference to FIGS. 2A and 2B. This embodiment is identical to the first embodiment except that the resonator holes 2*a*, 2*b* are capacitively coupled to the external electrode 4 via respective coupling electrode 6*a*, 6*b* formed on the front surface 21 of the dielectric block, rather than by the conductive coupling of the first embodiment. In this embodiment, there is no need to form gaps g in the inner electrodes formed on the resonator holes.

As with the first embodiment, the positions of the contact portions 5*a*", 5*b*" of the input/output electrodes can be varied relative to the positions of the excitation holes 3*a*, 3*b* thereby accruing the same beneficial results discussed above.

Third Embodiment

Figure 3A:
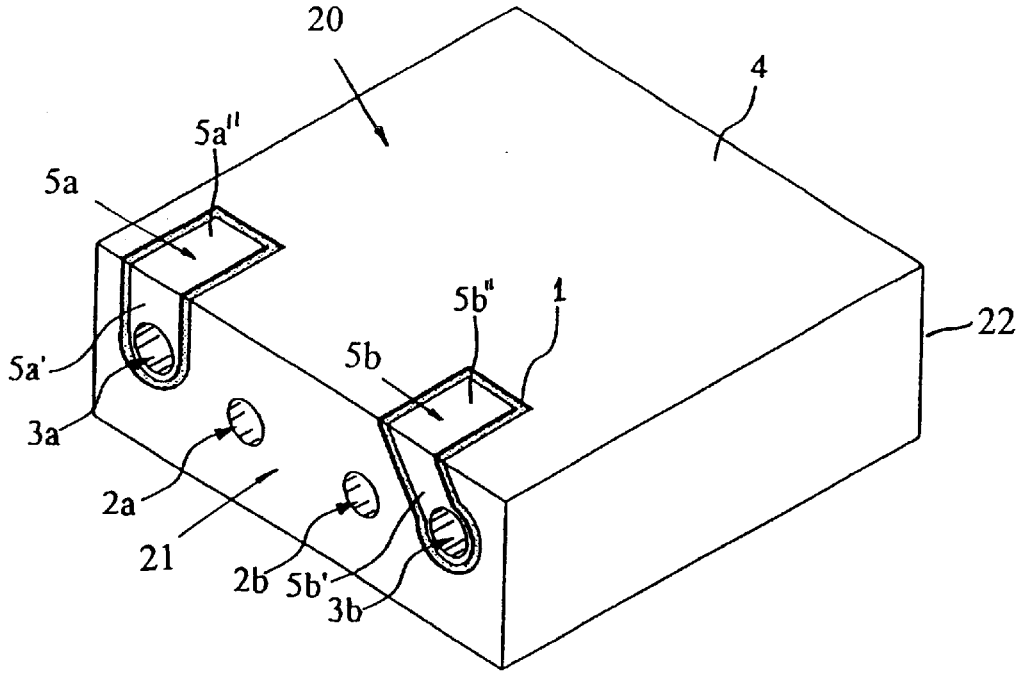
FIGS. 3A and 3B are perspective views of a dielectric filter according to a third embodiment of the present invention.
Figure 3B:
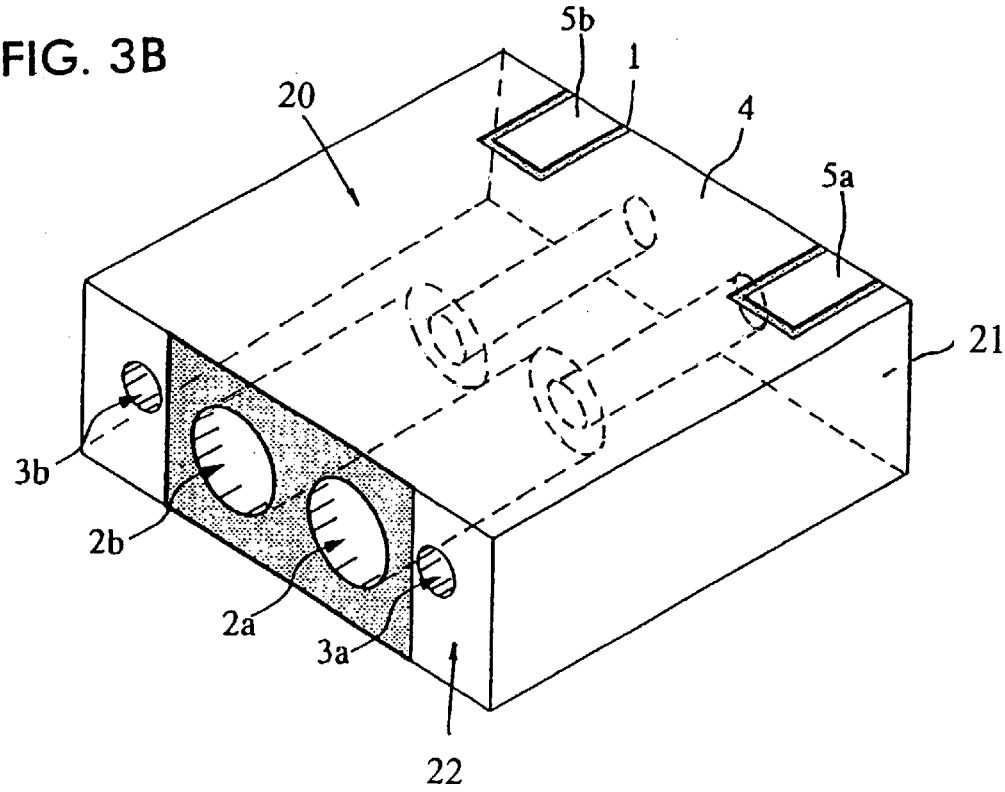

Next, the construction of a dielectric filter according to a third embodiment of the present invention will be described below with reference to FIGS. 3A and 3B. In this example, the external conductor 4 is not located on the rear surface 22 of the dielectric block 1 in the area surrounding the end of the through holes 2*a*, 2*b*, thereby forming an open circuited end of the resonators (without the formation of a gap g). Each of the resonator holes 2*a* and 2*b* has a stepped construction in which their inner diameter is smaller on the short-circuited end side of the resonators and is larger on the open end side thereof. The remaining construction is the same as that of the first and second embodiments.

With this construction, the two resonators are capacitively coupled with each other. Like the first two embodiments, the fact that at least one connection portion of the input/output electrodes (in this embodiment, connection portion 5*b*') is disposed in a direction which forms an oblique angle with (more generally, is not perpendicular to) the mounting surface 20 ensures the design flexibility noted above.

Fourth Embodiment

Next, the construction of a dielectric duplexer according to a fourth embodiment of the present invention will be described below with reference to FIGS. 4A, 4B, and 4C.

Figure 4A:
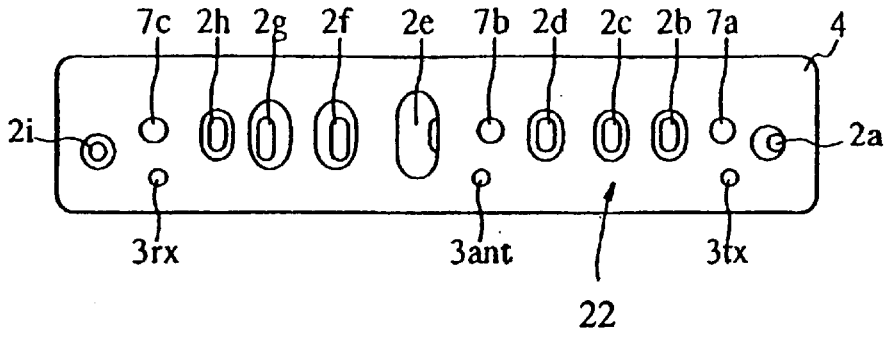
FIGS. 4A, 4B, and 4C show the construction of a dielectric duplexer according to a fourth embodiment of the present invention.
Figure 4B:
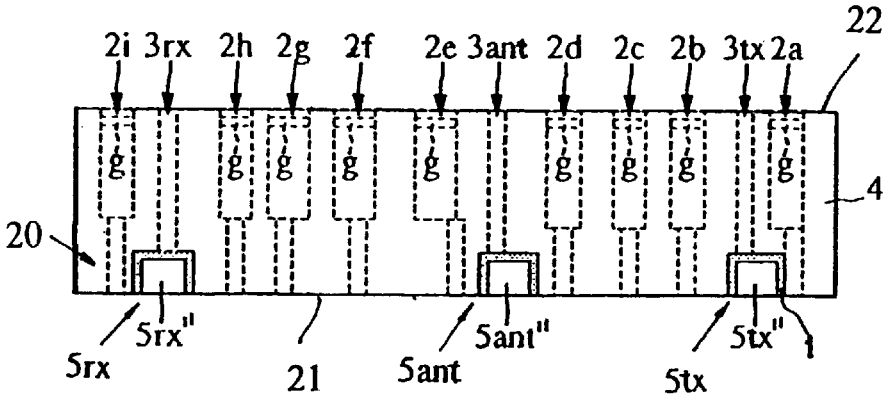

FIG. 4B is a plan view of the mounting surface 20 of a dielectric duplexer. FIG. 4C is a view of the front surface 21 of the dielectric duplexer corresponding to the short circuited ends of the resonators. FIG. 4A is a view of the rear surface 22 of the dielectric duplexer corresponding to the open circuited end of the resonator.

The duplexer is formed in a dielectric block 1 having a generally parallelepiped shape. An external conductor 4 is formed on the outer surfaces of the dielectric block 1. A plurality of stepped resonator holes 2*a* through 2*i* are formed in the dielectric block 1 extending from the front surface 21 to the rear surface 22 thereof. Grounding holes 7*a* through 7*c* and excitation holes 3*tx*, 3*ant*, and 3*rx* are also provided in the dielectric block 1, extending from the front surface 21 to the rear surface 22 thereof.

Figure 4C:
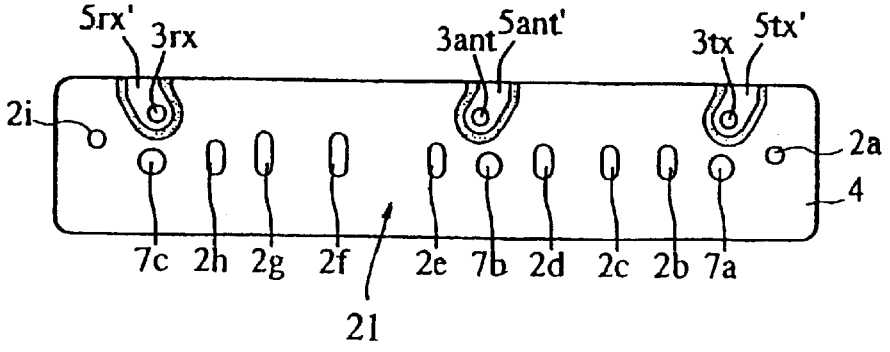

As best shown in FIGS. 4A and 4C, the resonator holes 2*a* through 2*i* are elongated in a direction perpendicular to the mounting surface 20 of the dielectric block 1. As a result, the dimensions of the block and the width direction as viewed in FIGS. 4A–4C can be reduced.

As best shown in FIG. 4B, each of the resonator holes 2*a* through 2*i* are stepped holes whose top section (corresponding to the open circuited end of the resonators) is relatively large and whose bottom section (corresponding to the short circuited end of the resonators) is relatively small.

Respective inner conductors are formed on the inner surface of the resonator holes 2*a* through 2*i*. These conductors are directly connected to the external conductor 4 on the rear surface 21 to form short circuited ends of the resonators. An unplated gap g is formed on the upper end of each of the resonator holes so as to separate the internal conductors of the resonator holes from the external conductor 4 thereby forming the open circuited ends of the resonators.

Each of the excitation holes 3*tx*, 3*ant* and 3*rx* are coated with a respective internal conductor which extends through the entire length of the excitation holes. One end of the excitation holes is short circuited to the outer conductor 4 at the front face 22 of the dielectric block 1, the other end of the excitation holes is coupled to respective input/output electrodes 5*tx*, 5*ant* and 5*rx* which are formed on the rear face 21 of the dielectric block and extend onto the mounting surface 20 of the dielectric block 1 as shown in FIGS. 4B and 4C. These electrodes are spaced from the outer conductor 4 so as to be isolated therefrom. The input electrode 5*rx* is adapted to be connected to a receiver circuit, the electrode 5*ant* is adapted to be connected to an antenna and the electrode 5*tx* is adapted to be connected to a transmitter circuit.

The resonators 2*b* through 2*d* cooperate to form a transmitter band pass filter which permits a signal generated by the transmitter circuit (not shown) and applied to the excitation hole 3*tx* to be band pass filtered and applied to the antenna excitation hole 3*ant* and then the antenna (not shown). The filters 2*e* through 2*h* define a receiver band pass filter which band passes a signal received by the antenna and applied to the antenna excitation hole 3*ant* and applies the band pass signal to the receiver excitation hole 3*rx* and then to the receiver circuit (not shown).

The resonator 2*a* acts as a trap filter which causes a signal received by the transmitter excitation hole 3*tx* in the vicinity of the frequency boundary between transmission frequency band and the receiving frequency band to be attenuated. As a result, a transmission filter section is formed by resonators 2*a* through 2*d* which causes the transmit signal to pass through the transmission frequency band and causes a signal in the frequency band adjacent to the receiving frequency band to be greatly attenuated.

The resonator hole 2*i* acts as a trapping filter which causes a signal in the vicinity of a boundary between the receiving frequency band and the transmission frequency band to be attenuated. As a result, a receiving filter section is formed which causes a signal to pass through the receiving frequency band and causes a signal in the frequency band adjacent to the transmission frequency band to be greatly attenuated.

Opposite ends of the internal conductors formed on the inner surface of each grounding holes 7*a*, 7*b*, 7*c* are coupled to (short-circuited with) the external conductor 4. The grounding hole 7*a* blocks coupling between the two resonators defined by the resonator holes 2*a* and 2*b*. The grounding hole 7*b* blocks coupling between the two resonators defined by the resonator holes 2*d* and 2*e*. The grounding hole 7*c* blocks coupling between the two resonators defined by the resonator holes 2*h* and 2*i*.

The positions of the contact portions 5*tx*", 5*ant*", and 5*rx*" of the input/output electrodes 5*tx*, 5*ant* and 5*rx* on the mounting surface 20 are aligned with the positions of a corresponding contact terminals on the circuit board.

The locations of the excitation holes 3*tx*, 3*ant*, and 3*rx* are determined by the desired characteristics of the transmitter filter and the receiver filter. If the circuit board was not designed for this specific dielectric filter, or if design constraints of the circuit board limit the location of the contact terminals, the positions of the excitation holes will not match the corresponding positions of the contact terminals on the circuit board. To accommodate for this difference, the position of one or more of the contact portions 5*tx*", 5*and*", and 5*rx*" (in the present embodiment, all three contact portions) will be offset with respect to their corresponding excitation holes 3*tx*, 3*ant*, and 3*rx*. This offset is accommodated for by forming the corresponding connection portions 5*tx*', 5*ant*', and 5*rx*' in such a manner that they will extend from their corresponding excitation holes to their corresponding contact portions 5*tx*", 5*ant*", and 5*rx*" on the mounting surface 20. In the preferred embodiment, this is achieved by extending the connection portions 5*rx*', 5*ant*', and 5*rx*' at an oblique angle with (more generally not perpendicular to) the mounting surface 20.

Fifth Embodiment

Figure 5A:
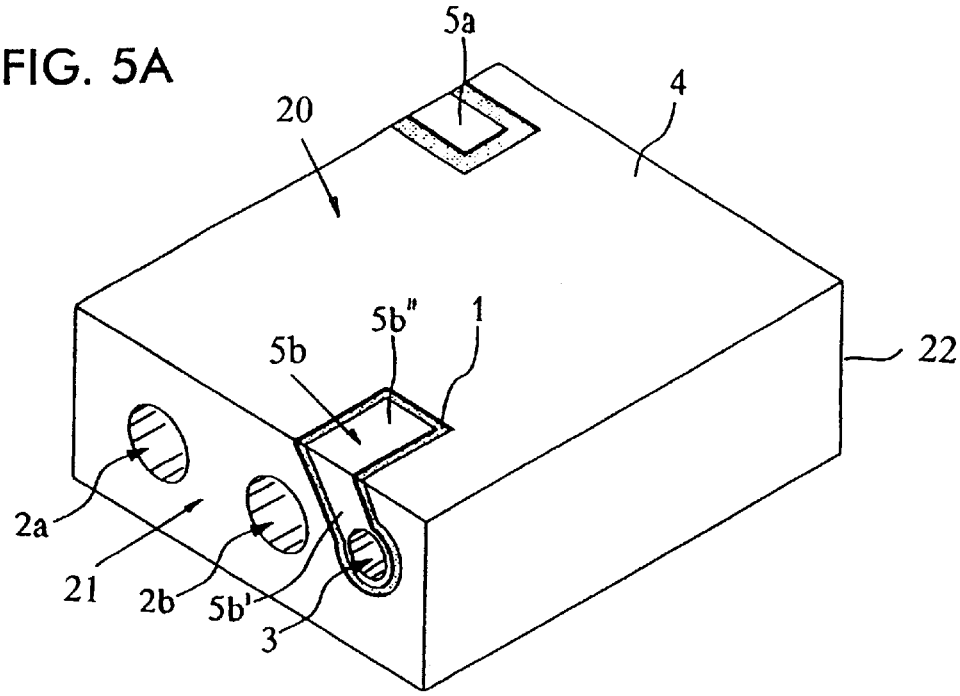
FIGS. 5A and 5B are perspective views of a dielectric filter according to a fifth embodiment of the present invention.
Figure 5B:
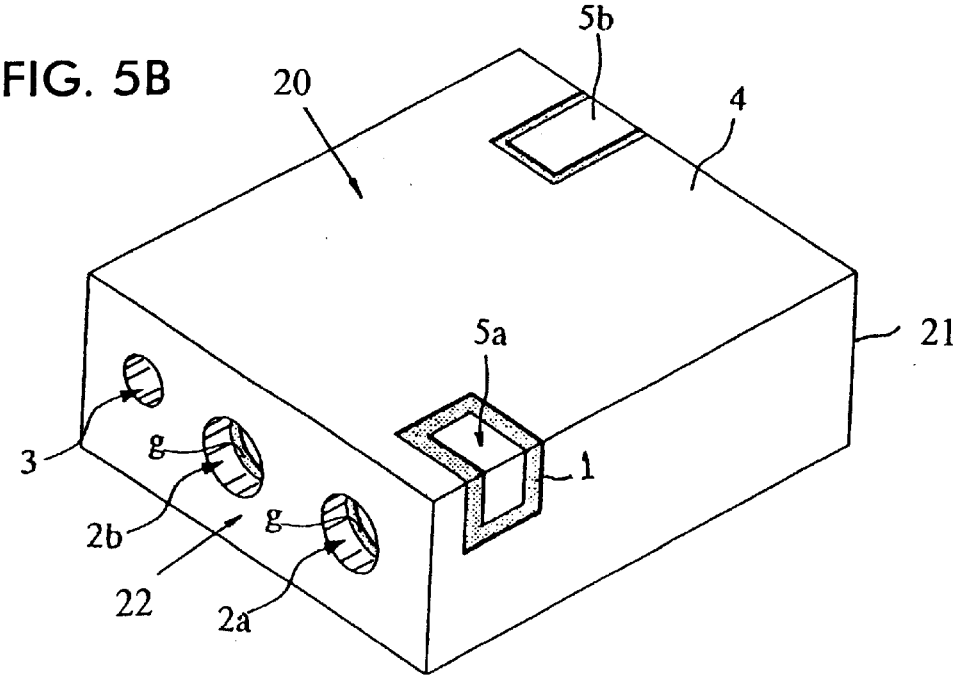

Next, the construction of a dielectric filter according to a fifth embodiment of the present invention will be described below with reference to FIGS. 5A and 5B. FIG. 5A is a perspective view of a dielectric filter in which the mounting surface 20 faces upward. FIG. 5B is a perspective view in which the dielectric filter of FIG. 5A is rotated 180° within the plane of the sheet on which FIG. 5A is drawn.

Unlike the example shown in FIGS. 1A and 1B, a single excitation hole 3 is provided in the dielectric block 1, and the input/output electrode 5*a* is formed on the lateral side surface of the dielectric block 1. The remaining construction is the same as that shown in FIGS. 1A and 1B.

The excitation hole 3, having an internal conductor formed in the inner surface thereof, is coupled in an interdigital manner to the resonator by the resonator hole 2*b*. The input/output electrode 5*a* is capacitively coupled to the resonator defined by the resonator hole 2*a*.

Because the connection portion 5*b*' of the input/output electrode 5*b* is disposed at an oblique angle with respect to (more generally not perpendicular to) the mounting surface 20, the design flexibility noted with respect to the prior embodiments can be achieved.

Sixth Embodiment

Next, the construction of a dielectric filter according to a sixth embodiment of the present invention will be described below with reference to FIGS. 6A and 6B.

Figure 6A:
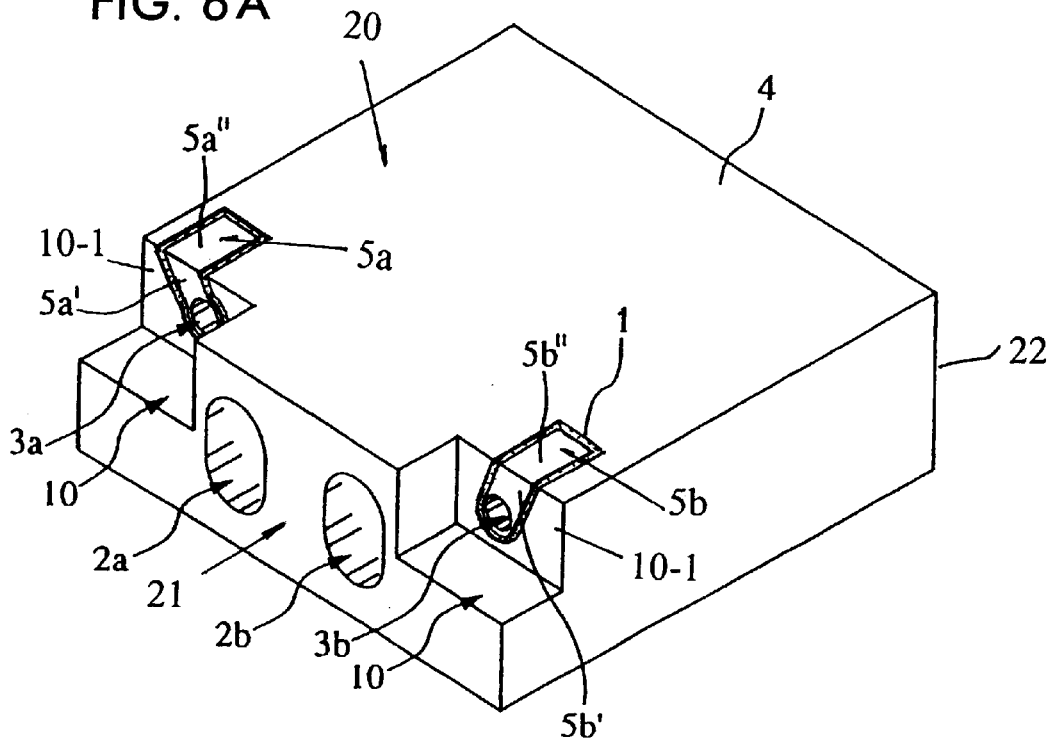
FIGS. 6A and 6B are perspective views of a dielectric filter according to a sixth embodiment of the present invention.

FIG. 6A is a perspective view of a dielectric filter in which the mounting surface 20 faces upward. FIG. 6B is a perspective view in which the dielectric filter of FIG. 6A is rotated 180° within the plane of the sheet on which FIG. 6A is drawn.

Unlike the example shown in FIGS. 1A and 1B, recessed portions 10, which are recessed in the axial direction of the excitation holes 3*a* and 3*b*, are formed on opposite sides of the front surface 21 of the dielectric block 1, and one end of each of the excitation holes 3*a* and 3*b* opens at a respective recessed portion 10. Connection portions 5*a*' and 5*b*' of the input/output electrodes 5*a* and 5*b*, respectively, are formed on the respective surfaces 10-1 of the steps 10 in electrical contact with the conductors formed on the excitation holes 3*a*, 3*b*, respectively. The connection portions 5*a*', 5*b*' extend at an oblique angle to (more generally not perpendicular to) the mounting surface 20 from the excitation holes 3*a*, 3*b* to the contact portions 5*a*", 5*b*". The remaining construction is the same as that shown in the first embodiment.

With this construction, it is possible to provide contact portions 5*a*", 5*b*" on the mounting surface 20 at spacings and positions that are different than those of the corresponding excitation holes 3*a*, 3*b* thereby accruing the design benefits noted above with respect to the prior embodiments.

Figure 6B:
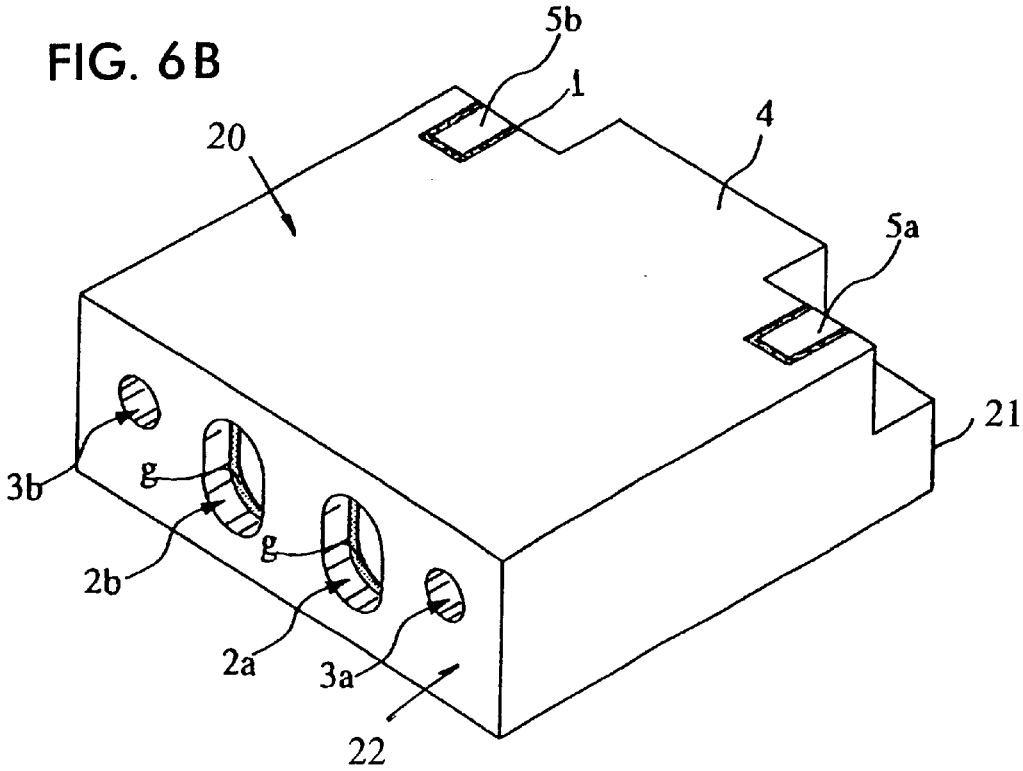

Although in the example shown in FIGS. 6A and 6B, two separate recessed portions 10 are formed at opposite ends of the front surface 21, a single recessed portion extending along the entire front surface 21 may be used. This is equally true for the embodiments described below Seventh Embodiment Next, the construction of a dielectric filter according to a seventh embodiment of the present invention will be described below with reference to FIGS. 7A and 7B.

Figure 7A:
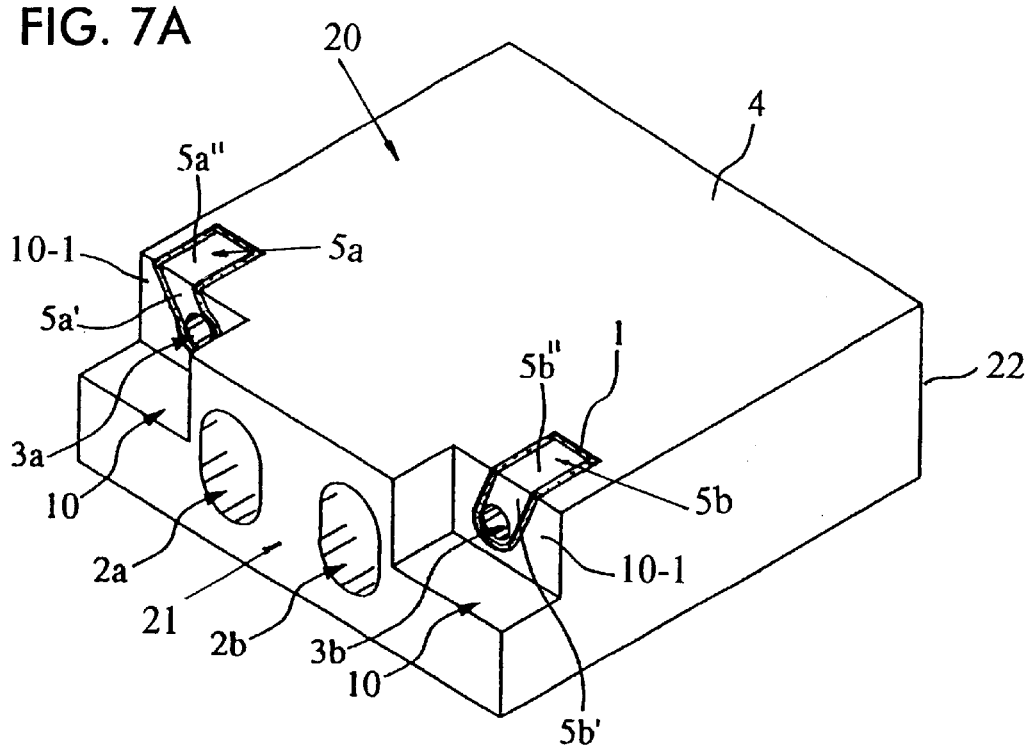
FIGS. 7A and 7B are perspective views of a dielectric filter according to a seventh embodiment of the present invention.
Figure 7B:
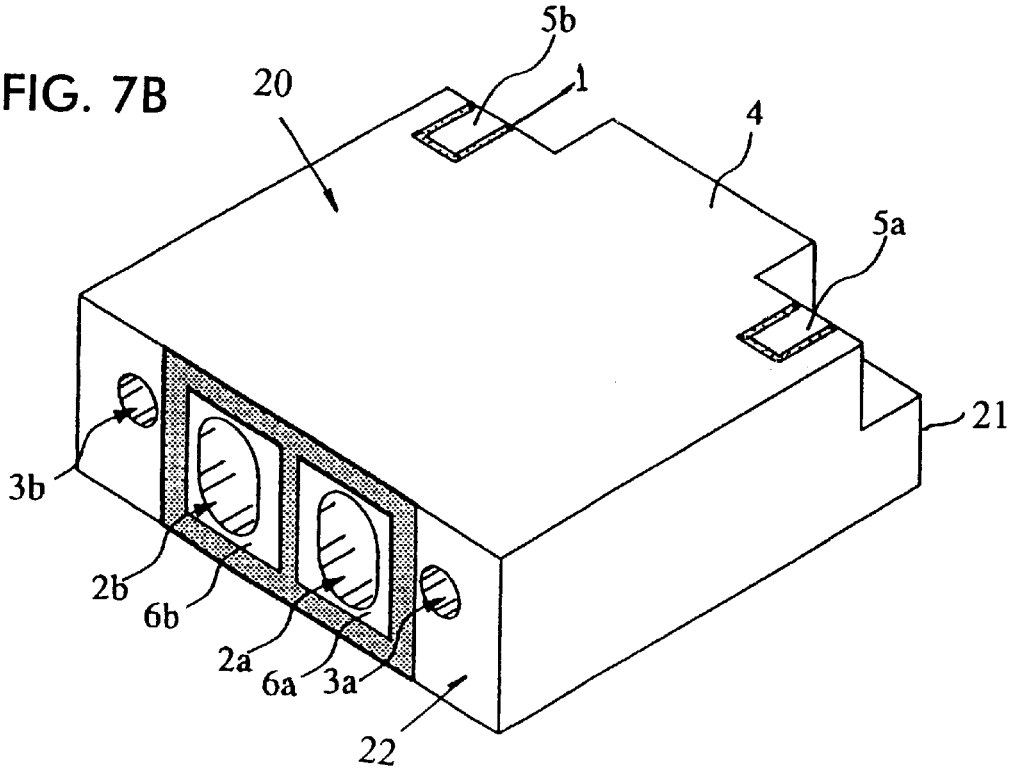

FIG. 7A is a perspective view of a dielectric filter in which the mounting surface 20 faces upward. FIG. 7B is a perspective view in which the dielectric filter of FIG. 7A is rotated 180° within the plane of the sheet on which FIG. 7A is drawn.

Unlike the example shown in FIGS. 6A and 6B, coupling electrodes 6*a* and 6*b*, which are directly coupled to the internal conductors within the resonator holes 2*a*, 2*b*, respectively, are formed on the rear surface 22 of the dielectric block 1. The coupling electrodes are spaced from the outer conductor 4 and from each other so that an electrostatic capacitance is made to occur between them. The remaining construction is the same as that of the sixth embodiment. With this construction, the two resonators corresponding to the resonator holes 2*a* and 2*b* are capacitively coupled with each other.

In this embodiment, recessed portions 10 are used as in the sixth embodiment. As in the sixth embodiment, the connection portions 5*a*', 5*b*' of the input/output electrodes 5*a*, 5*b*, respectively, extend at an oblique angle to the mounting surface 20 thereby making it possible to locate the contact portions 5*a*", 5*b*" at positions and spacings which are different than those of the excitation holes 3*a* and 3*b*.

Eighth Embodiment

Next, the construction of a dielectric filter according to an eighth embodiment of the present invention will be described below with reference to FIGS. 8A and 8B.

Figure 8A:
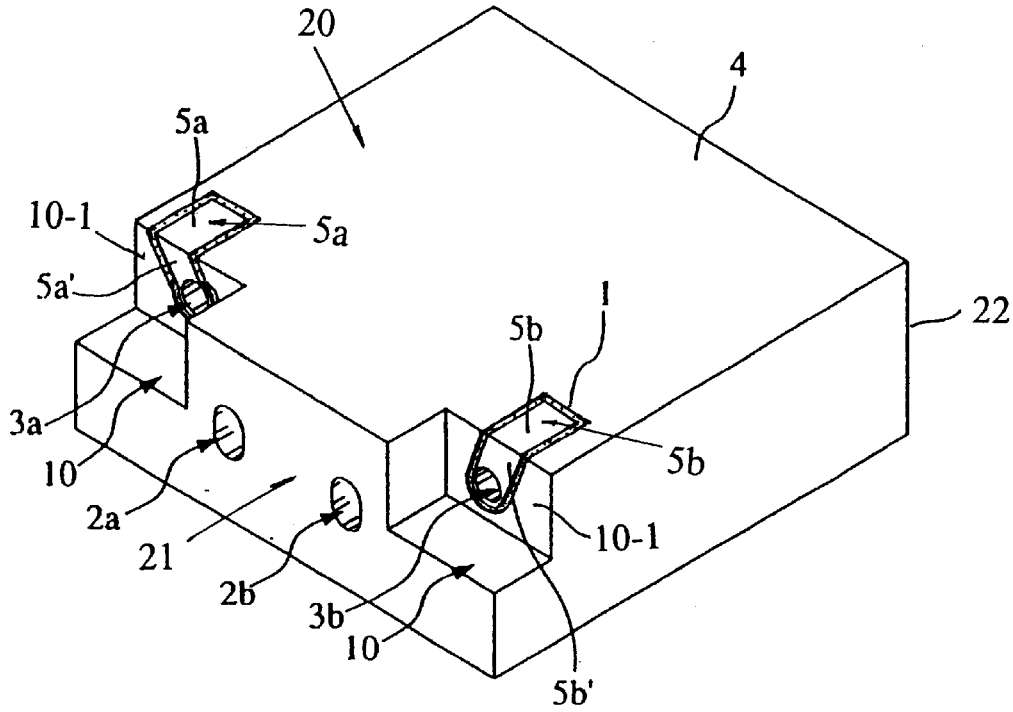
FIGS. 8A and 8B are perspective views of a dielectric filter according to an eighth embodiment of the present invention.
Figure 8B:
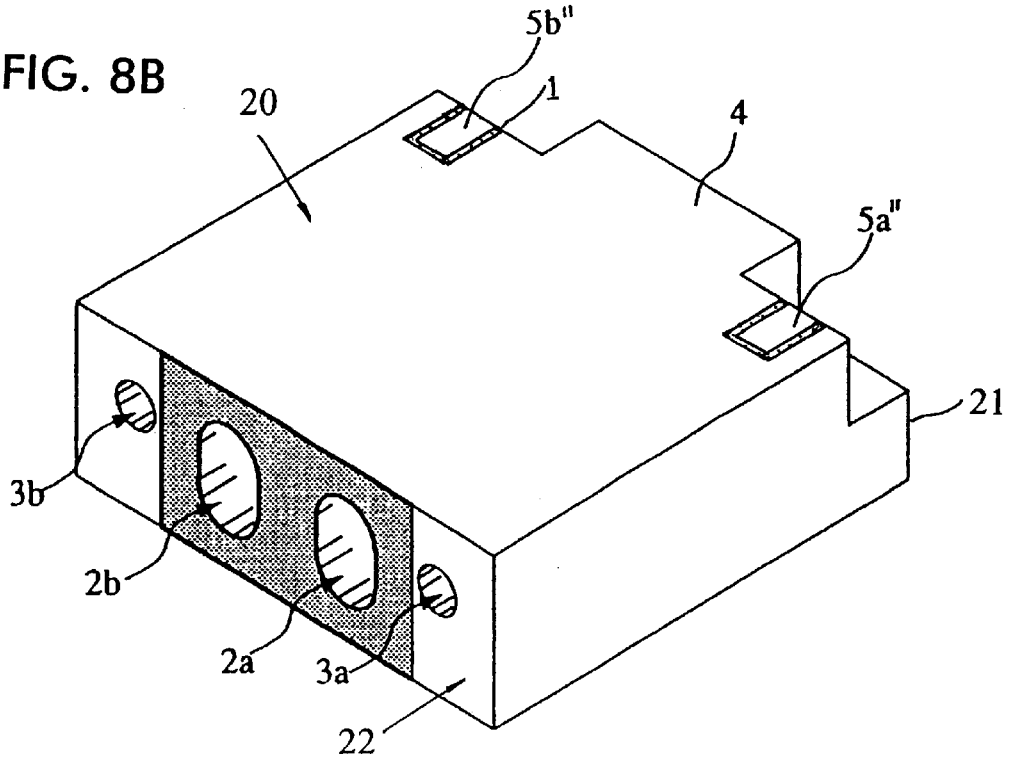

FIG. 8A is a perspective view of a dielectric filter in which the mounting surface 20 faces upward. FIG. 8B is a perspective view in which the dielectric filter of FIG. 8A is rotated 180° within the plane of the sheet on which FIG. 8A is drawn.

In this embodiment, one of the openings of each of the resonator holes 2*a* and 2*b* is formed as an open end. Also, each of the dielectric resonators is formed into a stepped construction (similar to FIGS. 3B) in which the inner diameter of the resonator holes 2*a* and 2*b* is smaller on the short-circuited end side and is larger on the open circuited end side. The remaining construction is the same as that of the sixth and seventh embodiments.

With this construction, the two resonators corresponding to the resonator holes 2*a* and 2*b* are capacitively coupled with each other. Once again, the connection portions 5*a*', 5*b*' of the input/output electrodes 5*a*, 5*b* extend at an oblique angle (more generally not perpendicular to) to the mounting surface 20 thereby providing the design flexibility discussed with respect to the foregoing embodiments.

Ninth Embodiment

Next, the construction of a dielectric filter according to a ninth embodiment of the present invention will be described below with reference to FIGS. 9A and 9B.

Figure 9A:
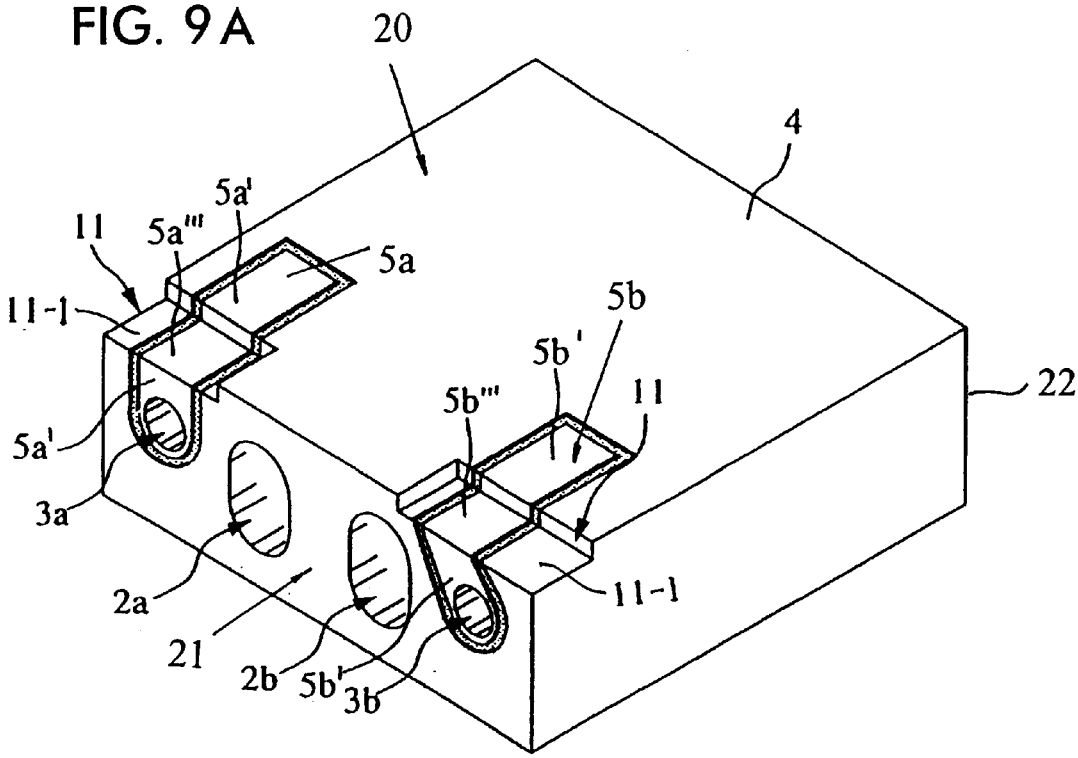
FIGS. 9A and 9B are perspective views of a dielectric filter according to a ninth embodiment of the present invention.

FIG. 9A is a perspective view of a dielectric filter in which the mounting surface 20 faces upward. FIG. 9B is a perspective view in which the dielectric filter of FIG. 9A is rotated 180° within the plane of the sheet on which FIG. 9A is drawn.

In this embodiment, step sections 11 are formed in the dielectric block 1 such that their surface 11-1 is 10 recessed from the mounting surface 20. Input/output electrodes 5*a* and 5*b* extend from the front surface 21 to the mounting surface 20 via the respective step sections 11. The remaining construction is the same as that of the first embodiment.

With this construction, the connection portions 5*a*'", 5*b*'". of the input/output electrodes 5*a*, 5*b* are spaced from the circuit board when the mounting surface 20 is mounted on the circuit board, thereby reducing the influence of any other circuits or conductors formed on the circuit board in an area corresponding to the step sections 11.

Tenth Embodiment

Next, the construction of a dielectric filter according to a tenth embodiment of the present invention will be described below with reference to FIGS. 10A and 10B.

Figure 10A:
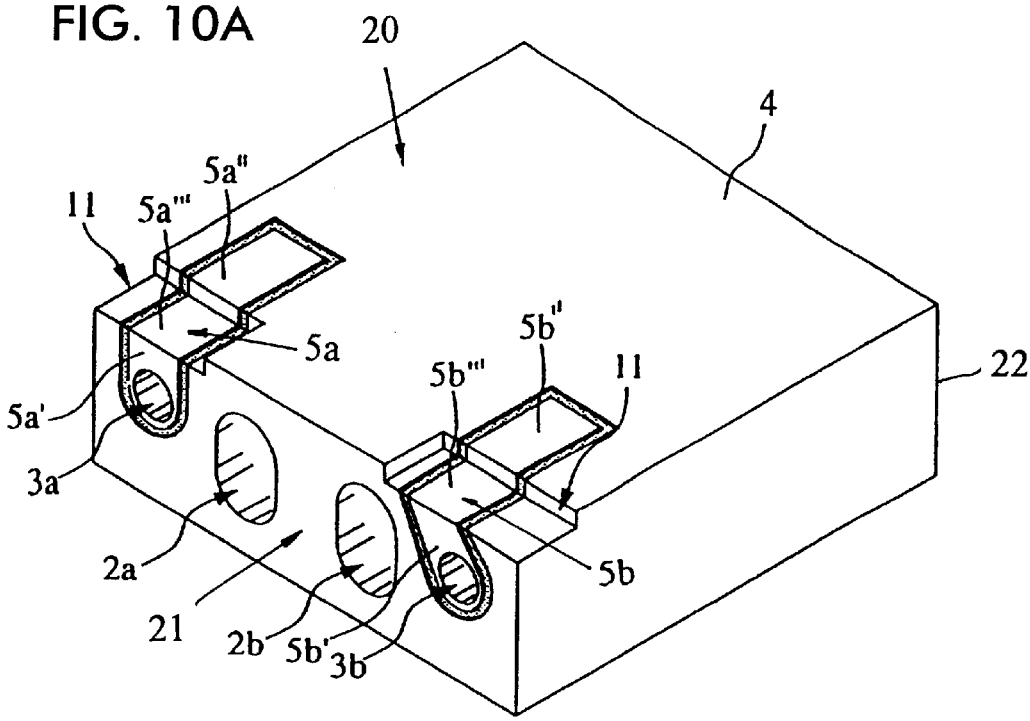
FIGS. 10A and 10B are perspective views of a dielectric filter according to a tenth embodiment of the present invention.

FIG. 10A is a perspective view of a dielectric filter in which the mounting surface 20 faces upward. FIG. 10B is a perspective view in which the dielectric filter of FIG. 10A is rotated 180° within the plane of the sheet on which FIG. 10A is drawn.

Figure 9B:
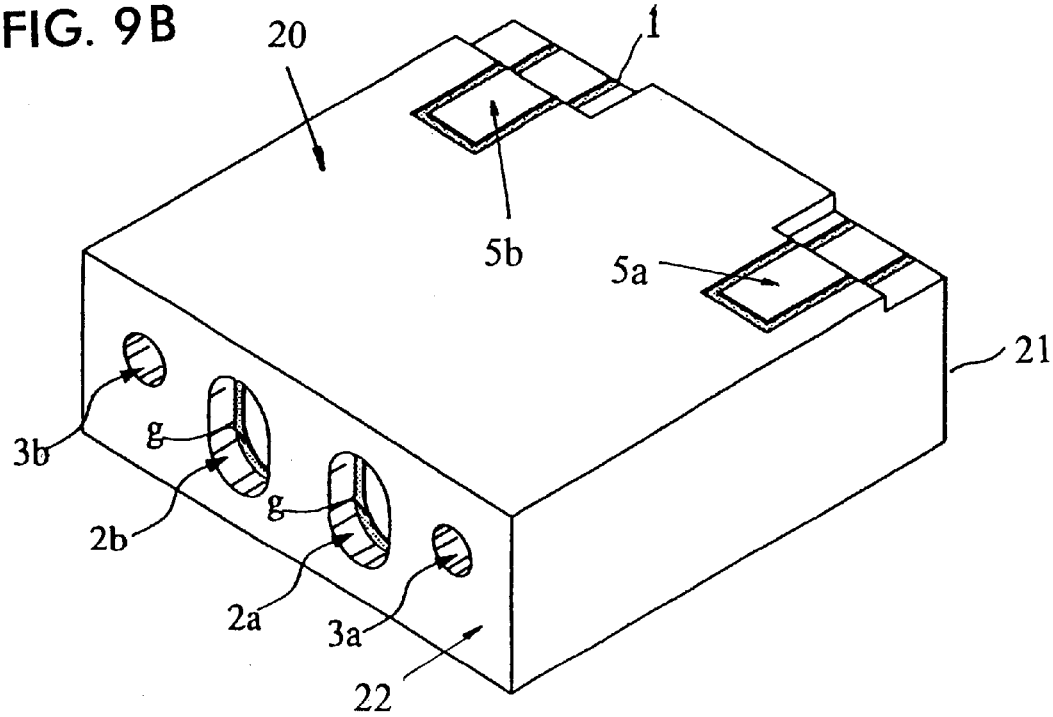

Unlike the example shown in FIGS. 9A and 9B, coupling electrodes 6*a* and 6*b*, which are directly connected to the internal conductors within the resonator holes, are formed on the rear surface 22 of the dielectric block 1. The coupling electrodes 6*a*, 6*b* are spaced from each other and from external electrode 4 so that an electrostatic capacitance is made to occur between them. The remaining construction is the same as that of the ninth embodiment.

In this embodiment, the electrode portion 5*b*' extends at an oblique angle to the mounting surface 20 whereby the position of the contact portion 5*b*", and its spacing from the contact portion 5*a*", can be different than the relative positions and spacings of the excitation holes 3*a*, 3*b*. This achieves the design advantages discussed above.

Eleventh Embodiment

Next, the construction of a dielectric filter according to an eleventh embodiment of the present invention will be described below with reference to FIGS. 11A and 11B.

Figure 11A:
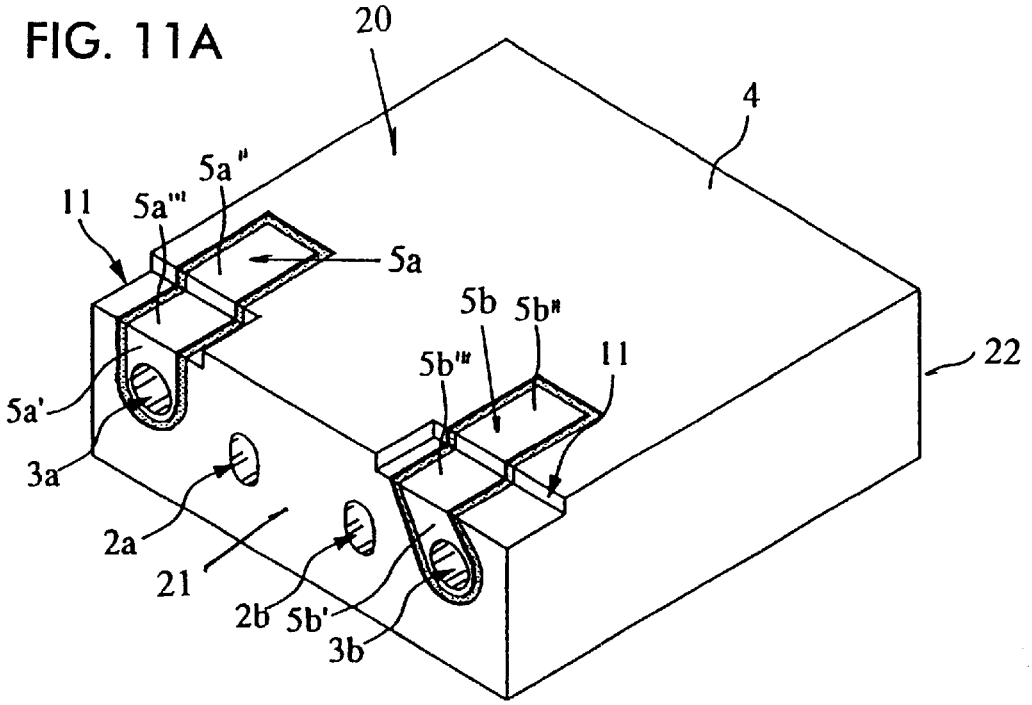
FIGS. 11A and 11B are perspective views of a dielectric filter according to an eleventh embodiment of the present invention.
Figure 11B:
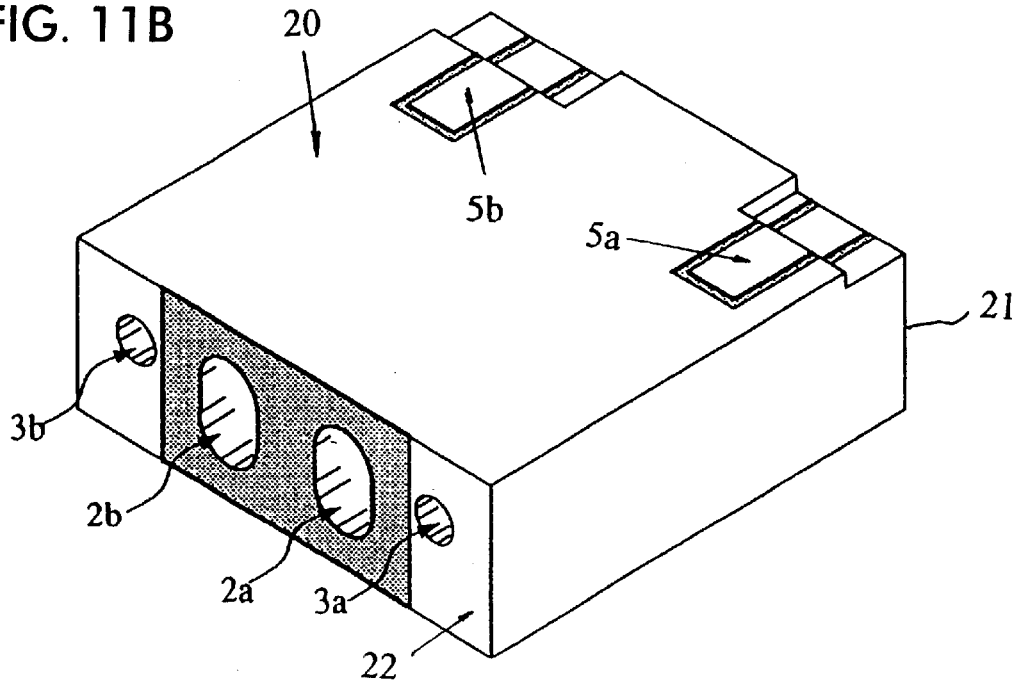

FIG. 11A is a perspective view of a dielectric filter in which the mounting surface 20 faces upward. FIG. 11B is a perspective view in which the dielectric filter of FIG. 11A is rotated 180° within the plane of the sheet on which FIG. 11A is drawn.

Figure 10B:
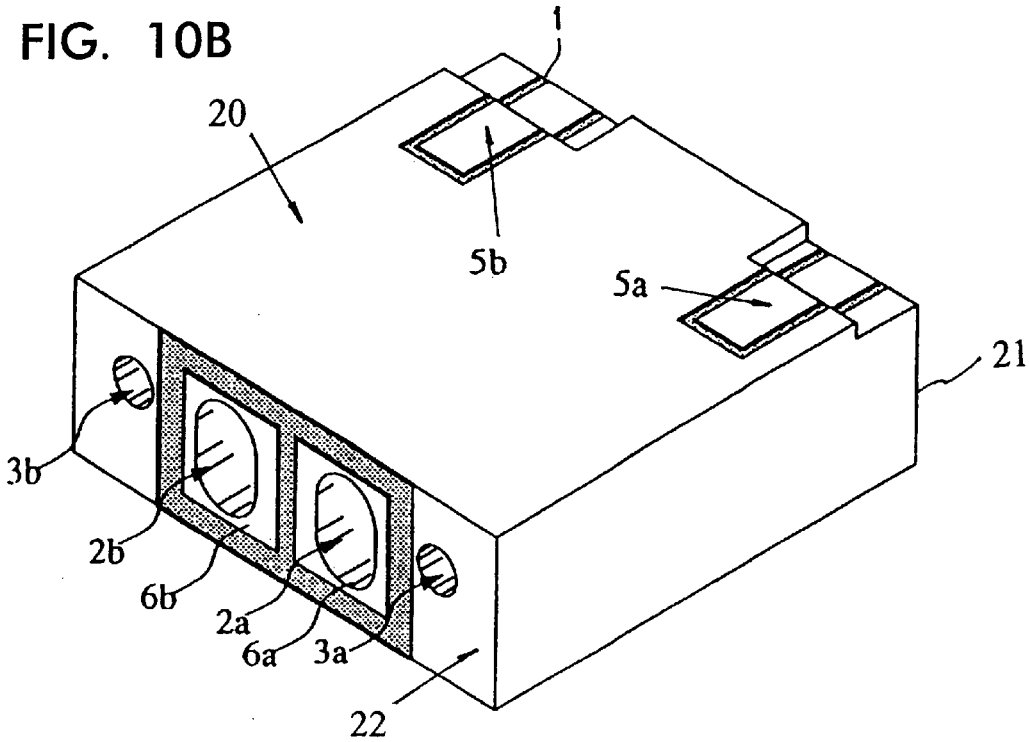

In this embodiment, the coupling capacitors of the embodiment of FIGS. 10A and 10B are omitted. One of the openings of each of the resonator holes 2*a* and 2*b* is formed as an open end. Also, each of the resonators is formed in a stepped construction (like FIG. 3B) in which the inner diameter of the resonator holes 2*a* and 2*b* is smaller on the short-circuited end of the resonators and is larger on the open circuited end thereof. The remaining construction is the same as that of the ninth and tenth embodiments. With this construction, the two resonators by the resonator holes 2*a* and 2*b* are capacitively coupled with each other.

Twelfth Embodiment

Next, the construction of a dielectric duplexer according to a twelfth embodiment of the present invention will be described below with reference to FIGS. 12A and 12B.

Figure 12A:
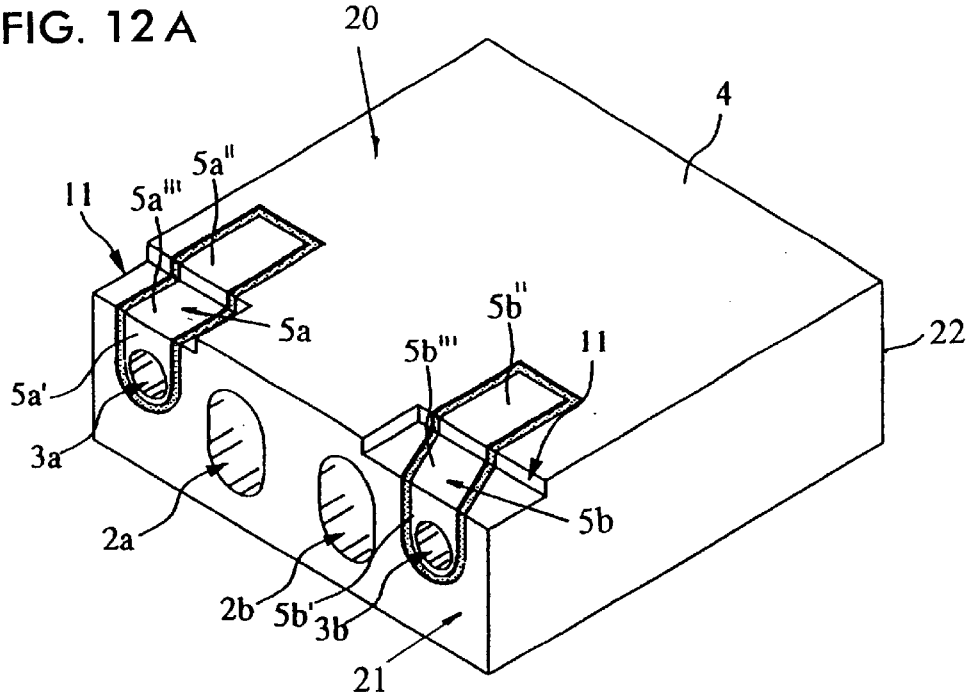
FIGS. 12A and 12B are perspective views of a dielectric filter according to a twelfth embodiment of the present invention.
Figure 12B:
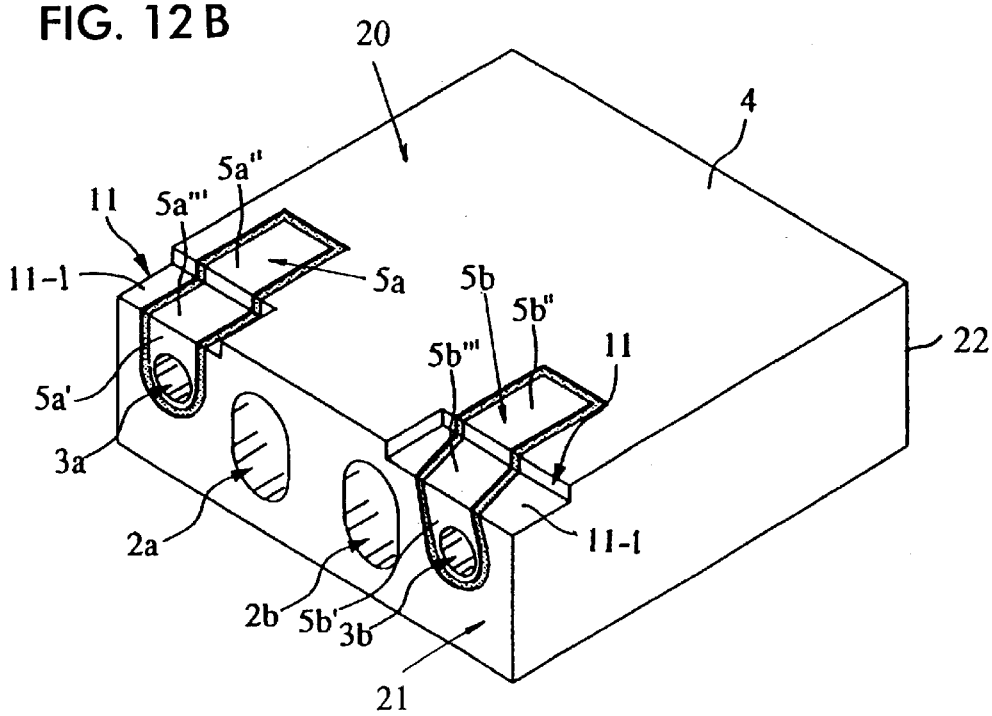

FIGS. 12A and 12B are perspective views of two dielectric filters in which the mounting surface 20 faces upward.

In the examples shown in FIGS. 9A and 9B to FIGS. 11A and 11B, the connection portions 5*a*''' and 5*b*''' of the input/output electrodes 5*a*, 5*b* located on the surface 111 of the step sections 11 extend parallel to the excitation holes 3*a* and 3*b*. In the examples shown in both FIGS. 12A and 12B (alternate but closely related embodiments), the connection portions 5*b*''' located on the surface 11-1 of the step section 11 extends at an oblique angle with respect to the excitation holes 3*a* and 3*b*. In the example shown in FIG. 12B, the connection portion 5*b*' extends at an oblique angle with respect to (more generally not perpendicular to) the mounting surface 20 from the opening of the excitation hole 3*b* to the step section 11 such that the offset in the positions of the terminal portion 5*b*" and the excitation hole 3*b* is compensated for by both the connection section 5*b*' and the connection section 5*b*'''. In contrast, in the embodiment of FIG. 12A (where the connection portion 5*b*' extends perpendicular to the mounting surface 20), the connection portion 5*b*''' alone achieves the desired compensation.

Although in the examples shown in FIGS. 12A and 12B, the connection portions 5*a*''' of the input/output electrode 5*a* located on the surface 11-1 of the left hand step section 11 extends in a direction parallel to the excitation hole 3*a*, both the connection portions 5*a*''' and 5*b*''' may extend at an oblique angle with respect to (more generally not perpendicular to) the excitation holes 3*a* and 3*b*, if desired.

Thirteenth Embodiment

Next, the construction of a dielectric duplexer according to a thirteenth embodiment of the present invention will be described below with reference to FIG. 13.

Figure 13:
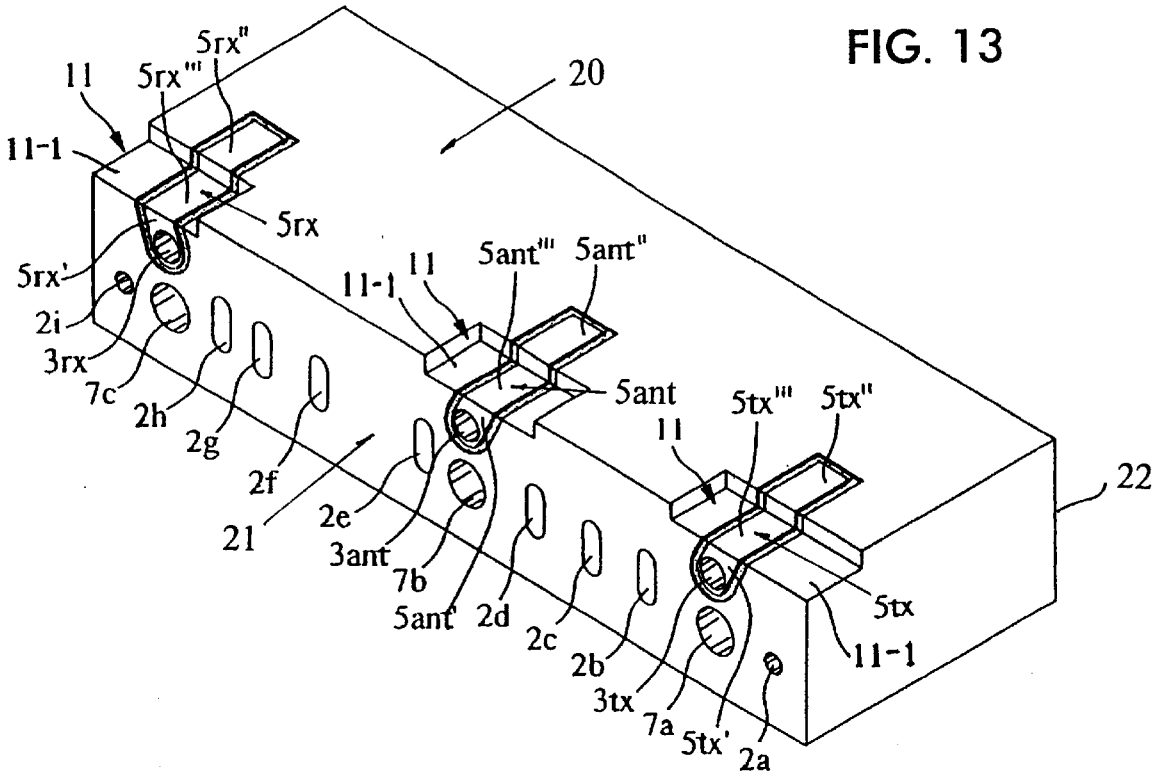
FIG. 13 is a perspective view of a dielectric duplexer according to a thirteenth embodiment of the present invention.

FIG. 13 is a perspective view of a dielectric duplexer with its mounting surface 20 facing upward. In this embodiment, three step sections 11, which are recessed from the mounting surface 20, are formed in the dielectric block 1. Each step section 11 is associated with a respective input/output terminal 5*rx*, 5*ant* or 5*tx* with which has a respective connection portion 5*rx*''', 5*ant*''', and 5*tx*''' formed on the step section 11. The remaining construction is the same as that of the fourth embodiment.

With such a construction, since the connection portions 5*rx*''', 5*ant*''' and 5*tx*''' are located on the surface 11-1 of the respective step section 11, they are spaced from the circuit board, thereby reducing any influence on the filter characteristics of the duplexer by circuits and/or conductors located on circuit board in the area of the step sections 11.

Fourteenth Embodiment

Next, the construction of a dielectric filter according to a fourteenth embodiment of the present invention will be described below with reference to FIG. 14.

Figure 14:
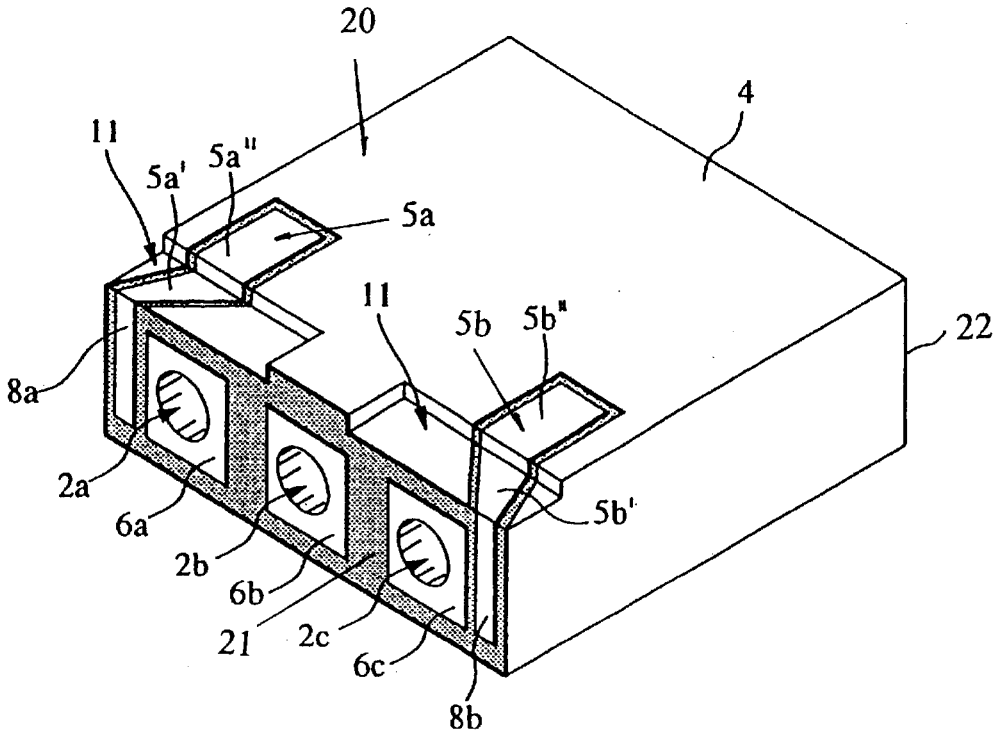
FIG. 14 is a perspective view of a dielectric filter according to a fourteenth embodiment of the present invention.

FIG. 14 is a perspective view of a dielectric filter in which the mounting surface 20 faces upward. Three resonator holes 2*a*, 2*b* and 2*c* are formed in a dielectric block having a parallelepiped shape and extend from a front surface 21 to a rear surface 22 thereof.

An internal conductor is formed on the inner surface of each of the resonator holes. An external conductor 4 is formed on five of the outer surfaces of the dielectric block 1 (all outer surfaces except the front surface 21). Coupling electrodes 6*a*, 6*b*, and 6*c*, which are continuous from the internal conductors of the resonator holes 2*a*, 2*b* and 2*c*, respectively, are formed on the front surface 21 of the dielectric block 1 so that an electrostatic capacitance is made to occur between adjacent coupling electrodes. Input/output coupling electrodes 8*a* and 8*b*, which are capacitively coupled to the coupling electrodes 6*a* and 6*c*, respectively, are also formed on the front face 21 of the dielectric block 1.

A pair of step sections 11 are formed on the mounting surface 20 of the dielectric block 1. Input/output terminals 5*a*, 5*b* extend from the coupling electrodes 8*a*, 8*b*, respectively, to the mounting surface 20. Input/output terminal 5*a* includes a connection portion 5*a*' which is located on the left step portion 11 and a contact portion 5*a*" which is located on the mounting surface 20. Similarly, terminal 5*b* includes a connection portion 5*b*' located on the right step portion 11 and a contact portion 5*b*" located on the mounting surface 20.

As this embodiment shows, the present invention can be applied to a dielectric filter of a type in which input/output is not taken via excitation holes, but is taken via input/output coupling electrodes.

Fifteenth Embodiment

Next, the construction of a dielectric filter according to a fifteenth embodiment of the present invention will be described below with reference to FIG. 15.

Figure 15:
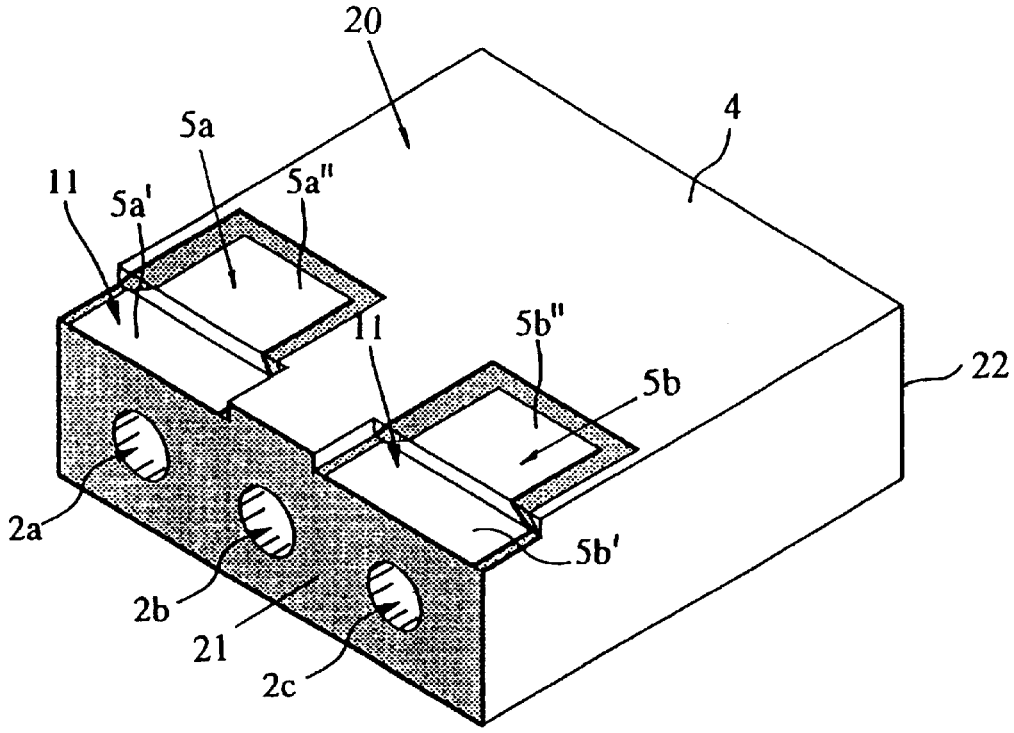
FIG. 15 is a perspective view of a dielectric filter according to a fifteenth embodiment of the present invention.

FIG. 15 is a perspective view of a dielectric filter in which the mounting surface 20 faces upward. In this embodiment, the front surface 21 is devoid of a conductive coating. A pair of step sections 11 are formed in the dielectric block 1 adjacent the front surface 21. A pair of input/output terminals, capacitively coupled to resonator holes 2*a*, 2*b*, extend over the step sections 11 onto the mounting surface 20. Each of the terminals 5*a*, 5*b*, include a connection portion 5*a*', 5*b*' located on the respective step portion and a contact portion 5*a*", 5*b*" located on the mounting surface 20. The remaining construction is the same as that shown in FIG. 14.

As shown by this embodiment, the present invention can be applied to a dielectric filter of a type in which electrodes, which are capacitively coupled to the resonators in the vicinity of the open ends of the resonators, are formed on surfaces which lie parallel to the mounting surface 20.

Figure 16:
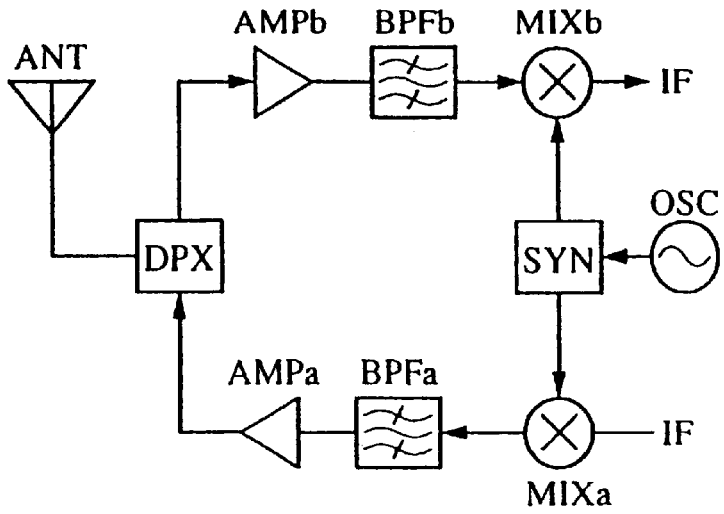
FIG. 16 is a block diagram showing the construction of a communication apparatus according to a sixteenth embodiment of the present invention.

Next, the construction of a communication apparatus according to a sixteenth embodiment of the present invention will be described below with reference to FIG. 16. Referring to FIG. 16, reference letter ANT denotes a transmission/receiving antenna. Reference letter DPX denotes a duplexer. Reference letters BPFa and BPFb each denote a band-path filter. Reference letters AMPa and AMPb each denote an amplification circuit. Reference letters MIXa and MIXb each denote a mixer. Reference letter OSC denotes an oscillator. Reference letter SYN denotes a frequency synthesizer.

The mixer MIXa mixes an intermediate-frequency signal IF of a transmission signal and the signal output from the frequency synthesizer SYN. The band-path filter BPFb causes only the signal of the transmission frequency band within the mixed output signal from the mixer MIXa to pass throughthrough. The amplification circuit AMPa amplifies the power of the output signal from the bandpath filter BPFb and transmits the signal from the transmission/receiving antenna ANT via the duplexer DPX. The amplification circuit AMPb amplifies the received signal extracted from the duplexer DPX. The band-path filter BPFb causes only the signal of the receiving frequency band within the received signal output from the amplification circuit AMPb to pass throughthrough. The mixer MIXb mixes a frequency signal output from the frequency synthesizer SYN and the received signal, and outputs the intermediate-frequency signal IF of the received signal.

For the duplexer section DPX shown in FIG. 16, a dielectric duplexer of the construction shown in FIG. 4 or 13 is preferably used. For the band-path filter sections BPFa and BPFb, a dielectric filter having the construction shown in FIGS. 1A and 1B to 3A and 3B, FIGS. 5A and 5B to 12A and 12B, FIG. 14, or FIG. 15 is preferably used.

According to the present invention, it is possible to cause the positions of the input/output electrodes on the mounting surface of the dielectric block to be aligned with the positions of the input/output electrodes on the circuit board, and the positions of the excitation holes in the dielectric block are determined according to the design which should satisfy required characteristics. As a result, when the characteristics of the dielectric filter or the dielectric duplexer are to be changed or when the design is to be changed, the changing of the design of the circuit board becomes unnecessary, and the degree of freedom of the design of the dielectric filter is improved.

Furthermore, according to the present invention, since the arrangement of the input/output coupling electrodes in the mounting area of the dielectric filter or the dielectric duplexer can be fixed, there is no need to use individual circuit boards which fit the dielectric filter or the dielectric duplexer to be mounted, resulting in a lower cost as a whole.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

In the embodiments disclosed, the position compensating connection portion of the input/output electrodes are straight portions which extend either at an oblique angle with respect to the mounting surface or at an oblique angle with respect to the excitation and/or resonator hole. However, the invention is not so limited. For example, the compensating connection portion(s) could extend along curved and/or zig zag path if desired.

In the preferred embodiments, at least one of the excitation holes has an input/output electrode associated therewith, the input/output electrode has a contact portion located on the mounting surface of the dielectric block at a position which is offset from the location of its associated excitation hole as viewed in a plane running parallel to the mounting surface. The input/output electrode also has a connection portion (which may include one or more sections) extending from the contact portion to the resonator hole.

As used herein, the phrase "generally rectangular parallelepiped shape" refers to a block having six major outer surfaces wherein respective adjacent pairs of the outer surfaces extend at an angle of between 75° and 105° with respect to one another and further includes such blocks having notches, indentations and/or projections on some or all of its major surfaces.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric filter comprising:

a dielectric block having a plurality of outer surfaces including a front surface and a planar mounting surface extending perpendicular to said front surface, said dielectric block including an excitation hole and a resonator hole, both of which extend from said front surface in a direction parallel to said mounting surface;

an excitation hole conductor formed on an inner surface of said excitation hole;

a resonator hole conductor formed on an inner surface of said resonator hole;

an input/output electrode electrically coupled to said excitation hole internal conductor, said input/output electrode including a connection portion located on said front surface and extending along a straight line which forms an oblique angle with respect to said mounting surface and a contact portion located on mounting surface, said contact portion being offset from said excitation hole as viewed along the plane of said mounting surface; and an external conductor, which is insulated from said input/output electrode, formed on a plurality of said outer surfaces.

2. A dielectric filter according to claim 1, wherein said outer surfaces of said dielectric block further include a rear surface spaced from and parallel to said front surface and wherein said resonator and excitation holes extend from said front to said rear surfaces.

3. A dielectric block according to claim 2, wherein said dielectric block has a generally rectangular parallelepiped shape.

4. A dielectric block according to claim 1, wherein said excitation hole is a first excitation hole, said excitation hole conductor is a first excitation hole conductor, said resonator hole is a first resonator hole and said resonator hole conductor is a first resonator hole conductor, said dielectric filter further comprising:

a second excitation hole and a second resonator hole formed in said dielectric block, both of which extend from said front surface in a direction parallel to said mounting surface;

a second excitation hole conductor formed on an inner surface of said second excitation hole;

a second resonator hole conductor formed on an inner surface of said second resonator hole; and a second input/output electrode electrically coupled to said second excitation hole internal conductor, said second input/output electrode including a connection portion located on said front surface and a contract portion located on said mounting surface.

5. A dielectric filter according to claim 4, wherein said connection portion of said second input/output electrode extends along a straight path that extends perpendicular to said mounting surface.

6. A dielectric filter according to claim 5, wherein one end of said first and second resonator hole conductors are short circuited to said external conductor and the opposite end of said first and second resonator hole conductors are spaced from, and therefore open circuited with respect to, said external conductor.

7. A dielectric filter according to claim 6, wherein said opposite end of said first and second resonator holes are spaced from said external conductor by respective gaps formed in said first and second resonator hole conductors.

8. A dielectric filter according to claim 6, wherein said first and second resonator hole conductors are capacitively coupled to one another by respective coupling electrodes formed on one of said outer surfaces of said dielectric block.

9. A dielectric filter according to claim 6, wherein said first and second resonator holes have stepped cross sections.

10. A dielectric filter according to claim 4, wherein said contact portion of said second input/output electrode is offset from said second excitation hole as viewed along the plane of said mounting surface.

11. A dielectric filter according to claim 10, wherein said connection portion of said second input/output electrode extends along a straight path that forms an oblique angle with respect to said mounting surface.

12. A dielectric filter according to claim 1, wherein said contact portion is rectangular in shape.

13. A dielectric filter according to claim 1, further comprising:

a second resonator hole formed in said dielectric block and extending from said front surface in a direction parallel to said mounting surface;

a second resonator hole conductor formed on an inner surface of said second resonator hole; and a second input/output electrode electrically coupled to said second resonator hole conductor.

14. A dielectric filter according to claim 13, wherein said dielectric block also includes a side surface lying perpendicular to both said front surface and said mounting surface and wherein said second input/output electrode is located on said side surface and said mounting surface but is not located on said front surface.

15. A duplexer having transmitter filter and a receiver filter, each of said transmitter and receiver filters having the structure of the dielectric filter of claim 1.

16. A dielectric filter, comprising:

a dielectric block having a plurality of outer surfaces including a front surface, a recessed surface which lies parallel to and spaced from said front surface and a planar mounting surface extending perpendicular to said front and recessed surfaces, said dielectric block including an excitation hole which extends from said recessed surface in a direction parallel to said mounting surface;

an excitation hole conductor formed on an inner surface of said excitation hole;

a resonator hole conductor formed on an inner surface of said resonator hole;

an input/output electrode electrically coupled to said excitation hole internal conductor, said input/output electrode including a connection portion located on said recessed surface an extending along a straight line which forms an oblique angle with respect to said mounting surface and a contact portion located on said mounting surface, said contact portion being offset from said excitation hole as viewed along the plane of said mounting surface; and an external conductor, which is insulated from said input/output electrode, formed on a plurality of said outer surfaces of said dielectric block.

17. A dielectric filter according to claim 16, wherein said outer surfaces of said dielectric block further include a rear surface spaced from and parallel to said front surface and wherein said resonator hole extends from said front surface to said rear surface and said excitation hole extends from said recessed surface to said rear surfaces.

18. A dielectric block according to claim 17, wherein said dielectric block has a generally rectangular parallelepiped shape.

19. A dielectric block according to claim 16, wherein said recess is a first recess, said excitation hole is a first excitation hole, said excitation hole conductor is a first excitation hole conductor, said resonator hole is a first resonator hole and said resonator hole conductor is a first resonator hole conductor, said dielectric block outer surfaces further including a second recessed surface which is spaced from and parallel to said front surface, said dielectric filter further comprising:

a second excitation hole formed in said dielectric block and extending from said second recessed surface in a direction parallel to said mounting surface;

a second resonator hole formed in said dielectric block and extending from said front surface in a direction parallel to said mounting surface;

a second excitation hole conductor formed on an inner surface of said second excitation hole;

a second resonator hole conductor formed on an inner surface of said second resonator hole; and a second input/output electrode electrically coupled to said second excitation hole internal conductor, said second input/output electrode including a connection portion located on said second recessed surface and a contact person located on said mounting surface.

20. A dielectric filter according to claim 19, wherein said connection portion of said second input/output electrode extends along a straight path that extends perpendicular to said mounting surface.

21. A dielectric filter according to claim 20, wherein said contact portion of said second input/output electrode is offset from said second excitation hole as viewed along the plane of said mounting surface.

22. A dielectric filter according to claim 21, wherein said connection portion of said second input/output electrode extends along a straight path that forms an oblique angle with respect to said mounting surface.

23. A dielectric filter according to claim 20, wherein one end of said first and second resonator hole conductors are short circuited to said external conductor and the opposite end of said first and second resonator hole conductors are spaced from, and therefore open circuited with respect to, said external conductor.

24. A dielectric filter according to claim 23, wherein said opposite end of said first and second resonator holes are spaced from said external conductor by respective gaps formed in said first and second resonator hole conductors.

25. A dielectric filter according to claim 23, wherein said first and second resonator holes have stepped cross sections.

26. A dielectric filter according to claim 16, wherein said contact portion is rectangular in shape.

27. A dielectric filter according to claim 26, wherein said first and second resonator hole conductors are capacitively coupled to one another by respective coupling electrodes formed on one of said outer surfaces of said dielectric block.

28. A dielectric filter, comprising:

a dielectric block having a plurality of outer surfaces including a front surface and a planar mounting surface extending perpendicular to said front surface and a recess formed in said block at the intersection of said front and mounting surfaces, said recess including a recessed surface spaced from and lying parallel to said mounting surface, said dielectric block including a resonator hole and an excitation hole, both of which extend from said front surface in a direction parallel to said mounting surface;

an excitation hole conductor formed on an inner surface of said excitation hole;

a resonator hole conductor formed on an inner surface of said resonator hole;

an input/output electrode electrically coupled to said excitation hole internal conductor, said input/output electrode including a first connection portion located on said front surface extending along a straight line which forms an oblique angle with respect to said mounting surface and a second connection portion located on said recessed surface and contact portion located on said mounting surface, said contact portion being offset from said excitation hole as viewed along the plane of said mounting surface; and an external conductor, which is insulated from said input/output electrode, formed on a plurality of said outer surfaces of said dielectric block.

29. A dielectric filter according to claim 28, wherein said outer surfaces of said dielectric block further include a rear surface space from and parallel to said front surface and wherein said resonator and excitation holes extend from said front surface to said rear surface.

30. A dielectric block according to claim 29, wherein said dielectric block has a generally rectangular parallelpiped shape.

31. A dielectric block according to claim 28, wherein said recess is a first recess, said excitation hole is first excitation hole, said excitation hole conductor is a first excitation hole conductor, said resonator hole is a first resonator hole and said resonator hole conductor is a first resonator hole conductor, said dielectric block further includes a second recess formed in said dielectric block at the intersection of said front and mounting surfaces, said second recess including a recessed surface spaced from and lying parallel to said mounting surface, said dielectric filter further comprising;

a second excitation hole formed in said dielectric block and extending from said front surface in a direction parallel to said mounting surface;

a second resonator hole formed in said dielectric block and extending from said front surface in a direction parallel to said mounting surface;

a second excitation hole conductor formed on an inner surface of said second excitation hole;

a second resonator hole conductor formed on an inner surface of said second resonator hole; and a second input/output electrode electrically coupled to said second excitation hole internal conductor, said second input/output electrode including a first connection portion located on said front surface and a second connection portion located on said recessed surface of said second recess and a contract portion located on said mounting surface.

32. A dielectric filter according to claim 31, wherein said first connection portion of said second input/output electrode extends along a straight path that extends perpendicular to said mounting surface.

33. A dielectric filter according to claim 32, wherein said second connection portion of said second input/output electrode extends along a straight path lying parallel to said second excitation hole.

34. A dielectric filter according to claim 31, wherein said contact portion of said second input/output electrode is offset from said second excitation hole as viewed along the plane of said mounting surface.

35. A dielectric filter according to 34, wherein said first connection portion of said second input/output electrode extends along a straight path that forms an oblique angle with respect to said mounting surface.

36. A dielectric filter according to claim 31, wherein one end of said first and second resonator hole conductors are short circuited to said external conductor and the opposite end of said first and second resonator hole conductors are spaced from, and therefore open circuited with respect to, said external conductor.

37. A dielectric filter according to claim 36, wherein said opposite end of said first and second resonator holes are spaced from said external conductor by respective gaps formed in said first and second resonator hole conductors.

38. A dielectric filter according to claim 36, wherein said first and second resonator hole conductors are capacitively coupled to one another by respective coupling electrodes formed on one of said outer surfaces of said dielectric block.

39. A dielectric filter according to claim 36, wherein said first and second resonator holes have stepped cross sections.

40. A dielectric filter according to claim 28, wherein said contract portion is rectangular in shape.

41. A dielectric filter according to claim 29, wherein said second connection portion extends along a straight path lying at an oblique angle relative to said excitation hole.

42. A duplexer having transmitter filter and a receiver filter, each of said transmitter and receiver filters having the structure of the dielectric filter of claim 28.

43. A dielectric filter, comprising:

a dielectric block having a plurality of outer surfaces including a front surface and a planar mounting surface extending perpendicular to said front surface and a recess formed in said block at the intersection of said front and mounting surfaces, said recess including a recessed surface spaced from and lying parallel to said mounting surface, said dielectric block including a resonator hole extending from said front surface in a direction parallel to said mounting surface;

a resonator hole conductor formed on an inner surface of said resonator hole;

a coupling electrode formed on said front face and electrostatically coupled to said resonator hole conductor;

an input/output electrode electrically coupled to said coupling electrode, said input/output electrode including a connection portion located on said recessed surface and a contact portion located on said mounting surface, said contact portion being offset from said excitation hole as viewed along the plane of said mounting surface; and an external conductor, which is insulated from said input/output electrode, formed on a plurality of said outer surfaces of said dielectric block.

44. A dielectric filter according to claim 43, wherein the connection section has a center line which extends at an oblique angle relative to said resonator hole.

* * * * *